US011181839B2

(12) United States Patent
Yamashita et al.

(10) Patent No.: US 11,181,839 B2
(45) Date of Patent: Nov. 23, 2021

(54) TONER AND METHOD FOR PRODUCING TONER

(71) Applicant: CANON KABUSHIKI KAISHA, Tokyo (JP)

(72) Inventors: Mariko Yamashita, Suntou-gun (JP); Tetsuya Kinumatsu, Mishima (JP); Tomohiro Unno, Susono (JP); Ryo Nagata, Tokyo (JP); Kosuke Fukudome, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/864,273

(22) Filed: May 1, 2020

(65) Prior Publication Data

US 2020/0363744 A1 Nov. 19, 2020

(30) Foreign Application Priority Data

May 13, 2019 (JP) ..... JP2019-090406

(51) Int. Cl.
*G03G 9/08* (2006.01)
*G03G 9/083* (2006.01)
*G03G 9/087* (2006.01)

(52) U.S. Cl.
CPC ..... *G03G 9/0833* (2013.01); *G03G 9/0806* (2013.01); *G03G 9/08711* (2013.01); *G03G 9/08755* (2013.01)

(58) Field of Classification Search
CPC .. G03G 9/0833; G03G 9/0806; G03G 9/0821; G03G 9/08755
USPC ..... 430/106.1, 111.4
See application file for complete search history.

(56) References Cited

U.S. PATENT DOCUMENTS

| | | | |
|---|---|---|---|
| 8,603,712 | B2 | 12/2013 | Aoki et al. |
| 8,741,519 | B2 | 6/2014 | Watanabe et al. |
| 8,785,101 | B2 | 7/2014 | Kaya et al. |
| 8,846,284 | B2 | 9/2014 | Kinumatsu et al. |
| 9,034,549 | B2 | 5/2015 | Shiotari et al. |
| 9,040,216 | B2 | 5/2015 | Fukudome et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |
| 9,256,148 | B2 | 2/2016 | Fujikawa et al. |
| 9,261,806 | B2 | 2/2016 | Moribe et al. |
| 9,285,697 | B2 | 3/2016 | Fukudome et al. |
| 9,309,349 | B2 | 4/2016 | Watanabe et al. |
| 9,429,860 | B2 | 8/2016 | Kinumatsu et al. |
| 9,470,993 | B2 | 10/2016 | Nishikawa et al. |
| 9,594,323 | B2 | 3/2017 | Fujikawa et al. |
| 9,606,462 | B2 | 3/2017 | Nomura et al. |
| 9,625,844 | B2 | 4/2017 | Kaya et al. |
| 9,658,554 | B2 | 5/2017 | Kinumatsu et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,857,713 | B2 | 1/2018 | Kosaki et al. |
| 9,869,943 | B2 | 1/2018 | Aoki et al. |
| 9,971,263 | B2 | 5/2018 | Fukudome et al. |
| 10,101,683 | B2 | 10/2018 | Nishikawa et al. |
| 10,197,934 | B2 | 2/2019 | Matsui et al. |
| 10,289,016 | B2 | 5/2019 | Fukudome et al. |
| 10,295,920 | B2 | 5/2019 | Nishikawa et al. |
| 10,295,921 | B2 | 5/2019 | Ohmori et al. |
| 10,303,075 | B2 | 5/2019 | Tanaka et al. |
| 10,409,180 | B2 | 9/2019 | Koji et al. |
| 10,545,420 | B2 | 1/2020 | Kinumatsu et al. |
| 10,578,990 | B2 | 3/2020 | Tsuda et al. |
| 2019/0041762 | A1 | 2/2019 | Yoshiba et al. |
| 2019/0137900 | A1* | 5/2019 | Nakagawa ..... G03G 9/08797 |
| 2019/0332027 | A1 | 10/2019 | Kenmoku et al. |
| 2020/0103774 | A1 | 4/2020 | Fukudome et al. |
| 2020/0103776 | A1 | 4/2020 | Kinumatsu et al. |
| 2020/0166861 | A1 | 5/2020 | Uratani et al. |
| 2020/0183293 | A1 | 6/2020 | Kinumatsu et al. |
| 2020/0183294 | A1 | 6/2020 | Fukudome et al. |
| 2020/0183296 | A1 | 6/2020 | Nishikawa et al. |

FOREIGN PATENT DOCUMENTS

| | | |
|---|---|---|
| JP | 2008-164771 | 7/2008 |
| JP | 2009-156902 | 7/2009 |

OTHER PUBLICATIONS

U.S. Appl. No. 16/864,341, Ryo Nagata, filed May 1, 2020.
U.S. Appl. No. 16/908,857, Tomohiro Unno, filed Jun. 23, 2020.
U.S. Appl. No. 16/908,885, Tetsuya Kinumatsu, filed Jun. 23, 2020.

* cited by examiner

*Primary Examiner* — Mark A Chapman
(74) *Attorney, Agent, or Firm* — Venable LLP

(57) ABSTRACT

A toner comprising a toner particle including a binder resin, wherein the toner is such that (1) when a powder dynamic viscoelasticity measurement method is used, a measurement start temperature is set to 25° C., and a ramp rate is set to 20° C./min, on a curve of a storage elastic modulus E' (Pa) where a temperature (° C.) is plotted against an abscissa and the storage elastic modulus E' is plotted against an ordinate, a temperature at a time when the E' at a start of a measurement has decreased by 50% is from 60° C. to 90° C., and (2) a load at a yield point of a displacement-load curve which is determined by a nanoindentation method and where a load (mN) is plotted against an ordinate and a displacement amount (μm) is plotted against an abscissa, is 0.80 mN or more; and a method for producing thereof.

17 Claims, No Drawings

TONER AND METHOD FOR PRODUCING TONER

BACKGROUND OF THE INVENTION

Field of the Invention

The present disclosure relates to a toner suitable for a recording method using an electrophotographic method, an electrostatic recording method, and a toner jet recording method, and to a method for producing the toner.

Description of the Related Art

An electrophotographic image forming apparatus is required to have higher speed, longer life, and energy saving, and in order to cope with these demands, further improvement of various performance characteristics is also required for a toner. In particular, further improvement in low-temperature fixability of a toner is required from the viewpoint of higher speed and energy saving. It is also important that the toner does not change in various transport environments and use environments. In particular, transportation and storage under high temperature and high humidity easily affect the toner, and it is desired that the toner have high heat-resistant storage performance.

In order to achieve low-temperature fixability, it is necessary to create a state in which a binder resin is plasticized at the time of fixing and is easily fused. Generally, it is possible to improve the fixing performance by using a toner having a binder resin which is designed to be soft. However, this method has a problem that the resin is soft not only during fixing, and the heat-resistant storage stability and the durability are problematic.

To solve this problem, for example, a toner having a core-shell structure has been proposed, thereby providing a toner having both low-temperature fixability and durability.

Japanese Patent Literature Publication No. 2009-156902 discloses a toner having a core-shell structure using a first binder resin and a second binder resin, thereby providing a toner in which the inside of the toner particle is soft and the outside is hard and which is satisfactory in terms of strength against mechanical stress and fixing performance.

Further, from the viewpoint of extending the service life it is necessary to increase the durability of the toner surface. The toner in the toner cartridge receives strong stress, for example, due to rubbing at various places. As the number of development operations increases, the number of times the toner receives stress increases, which causes cracking or crushing of the toner or embedding of an external additive. Since the cracking and crushing of the toner and the embedding of the external additive may reduce the flowability or charging performance of the toner, the surface of the toner particle needs to be hardened.

Japanese Patent Literature Publication No. 2008-164771 proposes a toner that is produced using a NANOINDENTER®, so that the elastic modulus of the toner can be regulated and high-quality images can be stably obtained for a long period of time.

SUMMARY OF THE INVENTION

However, even with the toner described in Japanese Patent Literature Publication No. 2009-156902, there is room for improvement in the durability in a high-speed electrophotographic image forming apparatus.

Further, with the toner described in Japanese Patent Literature Publication No. 2008-164771, satisfactory results in terms of fixing performance, density unevenness, fogging and the like are obtained, but there is room for improvement in mechanical strength of the toner.

The present disclosure provides a toner having excellent low-temperature fixability and excellent storage stability and durability, and a method for producing the toner.

A toner of the present disclosure is, a toner comprising a toner particle including a binder resin, wherein the toner is such that (1) when a powder dynamic viscoelasticity measurement method is used, a measurement start temperature is set to 25° C., and a ramp rate is set to 20° C./min, on a curve of a storage elastic modulus E' (Pa) where a temperature (° C.) is plotted against an abscissa and the storage elastic modulus E' is plotted against an ordinate, a temperature at a time when the storage elastic modulus E' at a start of a measurement has decreased by 50% is from 60° C. to 90° C., and (2) a load at a yield point of a displacement-load curve which is determined by a nanoindentation method and where a load (mN) is plotted against an ordinate and a displacement amount (μm) is plotted against an abscissa, is 0.80 mN or more.

A method for producing a toner of the present disclosure is, a method for producing a toner comprising a toner particle including a binder resin, the method comprising:

a step (I) of dispersing a polymerizable monomer composition including a polymerizable monomer capable of forming the binder resin in an aqueous medium, and forming particles of the polymerizable monomer composition in the aqueous medium, and a step (II) of polymerizing the polymerizable monomer included in the particles of the polymerizable monomer composition, wherein the toner is such that (1) when a powder dynamic viscoelasticity measurement method is used, a measurement start temperature is set to 25° C., and a ramp rate is set to 20° C./min, on a curve of a storage elastic modulus E' (Pa) where a temperature (° C.) is plotted against an abscissa and the storage elastic modulus E' is plotted against an ordinate, a temperature at a time when the storage elastic modulus E' at a start of a measurement has decreased by 50% is from 60° C. to 90° C., and (2) a load at a yield point of a displacement-load curve which is determined by a nanoindentation method and where a load (mN) is plotted against an ordinate and a displacement amount (μm) is plotted against an abscissa, is 0.80 mN or more.

According to the present disclosure, a toner having excellent low-temperature fixability and excellent storage stability and durability, and a method for producing the toner can be provided.

Further features of the present invention will become apparent from the following description of exemplary embodiments.

DESCRIPTION OF THE EMBODIMENTS

In the present disclosure, the description of "from XX to YY" and "XX to YY" representing a numerical range means a numerical range including a lower limit and an upper limit which are end points, unless otherwise specified. Further, the description of "A and/or B" is a concept including both the case of A, the case of B, and the case of both A and B.

The present inventors have comprehensively studied a toner for which low-temperature fixability and also storage stability and durability can be achieved.

Based on the results obtained by the present inventors, it has been found that the durability of the toner becomes more disadvantageous in a high-temperature environment. The reason therefor is that at a higher environmental temperature, the toner is likely to soften and more likely to be cracked and crushed at the time of durability output. As a result, the flowability of the toner decreases, the charging performance decreases, and fogging occurs.

Cracking and crushing of the toner are more likely to occur when inorganic fine particles such as silica fine particles are present on the surface of the toner particle. This is because where the toner is softened in a high-temperature environment, the inorganic fine particles on the surface of the toner particle are easily embedded in the toner. The embedding of the inorganic fine particles in the toner is more likely to occur during long-term use in a cartridge.

That is, when the toner is subjected to mechanical stress, for example, where inorganic fine particles are present on the surface of the toner particles, the contact area between the particles of the toner is reduced, and the mechanical stress can be dispersed. However, the inorganic fine particles on the surface of the toner particle may migrate from the surface of the toner particle to the inside of the toner particle due to long-term use in a cartridge. As a result, the number of inorganic fine particles on the surface of the toner particle for dispersing the mechanical stress is substantially reduced, so that the toner is easily cracked and crushed, and the charging performance is reduced.

Meanwhile, where the hardness of the toner is increased in order to prevent the cracking and crushing of the toner, the melting and spreading of the toner at the time of fixing tends to be insufficient, and the below-described trailing edge offset serving as an index of low-temperature fixability tends to occur.

Generally, film fixing is performed at a small heat capacity and light pressure, so that sufficient heat may not be transmitted to the toner. In recent years, printers are often used in various environments around the world. In particular, in a high-humidity environment, the heat of the fixing film is taken by moisture, and the amount of heat given to the toner may be further reduced.

Where the temperature of the fixing film is too low, the toner does not melt sufficiently, and a temperature gradient is generated inside the toner layer, so that the boundary surface temperature between the lowermost surface of the toner layer and the paper surface does not become a temperature sufficient to melt the toner, and the toner layer is broken. The resulting problem is a cold offset in which the toner adheres to the fixing film when passing through the fixing nip, makes a round while being adhered to the film, and is fixed on the paper.

When the toner laid-ion level on the paper increases during image printing at a high print percentage such as printing of a full-surface solid black image, the amount of heat applied to each toner particle is reduced, and the cold offset phenomenon is particularly likely to occur at the trailing edge portion (this is particularly referred to as a trailing edge offset). This is because the heat of the fixing film is taken by the toner placed on the front half of the paper, so that the toner transferred to the trailing edge of the paper is more difficult to melt.

A study conducted by the inventors of the present invention have shown that the toner on the paper with a full-surface solid black image fixed at the lowest temperature at which the trailing edge offset does not occur is fixed in a state where the lumps are melted and connected while about 50% thereof remains intact, and the toner particles are not sufficiently bonded. That is, it has been found that the trailing edge offset is a phenomenon caused by insufficient adhesion between the particles of the toner. Therefore, it has been found that in order to prevent the trailing edge offset, it is important to melt the toner at a lower temperature, thereby achieving a viscous state, and to improve the adhesion between the particles of the toner.

However, where the melt viscosity of the toner is simply reduced to solve the problem, brittle fracture of the toner itself is likely to occur when the process speed is increased or the number of development operations is increased.

As described above, there is a trade-off relationship between the prevention of the toner cracking and crushing and the prevention of the trailing edge offset, and it has been difficult to achieve both of them when increase in speed and extension of service life of a printer under a severe environment is considered.

With the toner of the present disclosure, cracking and crushing of the toner can be prevented at a high level even in a high-temperature environment, and at the same time, an image free of trailing edge offset can be obtained even in a high-humidity environment.

That is, a toner of the present disclosure is, a toner comprising a toner particle including a binder resin, wherein the toner is such that (1) when a powder dynamic viscoelasticity measurement method is used, a measurement start temperature is set to 25° C., and a ramp rate is set to 20° C./min, on a curve of a storage elastic modulus E' (Pa) where a temperature (° C.) is plotted against an abscissa and the storage elastic modulus E' is plotted against an ordinate, a temperature at a time when the storage elastic modulus E' at a start of a measurement has decreased by 50% is from 60° C. to 90° C., and (2) a load at a yield point of a displacement-load curve which is determined by a nanoindentation method and where a load (mN) is plotted against an ordinate and a displacement amount (μm) is plotted against an abscissa, is 0.80 mN or more.

The present inventors first studied a toner capable of maintaining strength even in a high-temperature environment. In the present disclosure, a nanoindentation method is used as an index of the toner strength. The nanoindentation method is an evaluation method in which a diamond indenter is pushed into a sample placed on a stage, a load (indentation strength) and displacement (indentation depth) are measured, and mechanical properties are analyzed from the obtained load-displacement curve.

As a method for evaluating the mechanical properties of a toner, a micro-compression tester has been conventionally used. In the micro-compression test, the indenter is larger than the toner size, and the test is suitable for evaluating macromechanical properties of the toner.

However, cracking and crushing of the toner, and particularly cracking, which is the focus of the present disclosure, is affected by the micromechanical properties of the toner, so that property evaluation in a smaller region is needed. In the measurement by the nanoindentation method, the indenter has a triangular pyramidal shape, and the tip of the indenter is much smaller than the toner size. Therefore, this method is suitable for evaluating the micromechanical properties of the toner.

The present inventors have conducted intensive studies and found that it is important to control a load at the yield point obtained from measurement using the nanoindentation method as a micromechanical property of the toner to a specific range.

That is, in the toner of the present disclosure, a load corresponding to the yield point on a displacement-load curve where a load (mN) is plotted against the ordinate and a displacement amount (μm) is plotted against the abscissa, which is determined by the nanoindentation method, is 0.80 mN or more.

In the measurement using the nanoindentation method, an indenter is pushed into a sample while continuously changing a very small load on the toner, the displacement at that time is measured, and a displacement-load curve where the load (mN) is plotted against the ordinate and the displacement amount (μm) is plotted against the abscissa is created.

It is considered that at a load at which the differential curve obtained by differentiating the load-displacement curve by the load has a maximum value, that is, at a load at which the slope on the load-displacement curve is at a maximum, the toner undergoes large deformation, that is, the phenomenon corresponding to cracking occurs. Accordingly, in the present disclosure, the load at which the slope on the load-displacement curve is at a maximum is taken as the load at which the toner cracks, and the load is defined as the "yield point". In other words, a high load at which the slope is at a maximum indicates that a high load is required for the toner to crack, which indicates that the toner is more difficult to crack.

It has been found that by controlling the load corresponding to the yield point to 0.80 mN or more, an effect of preventing cracking and crushing of the toner, particularly in a high-temperature environment, can be obtained in a system having a high speed and a long life. In addition, storage stability in a high-temperature environment is significantly improved.

The load corresponding to the yield point is preferably 0.85 mN or more, and more preferably 0.87 mN or more.

The upper limit of the load corresponding to the yield point is not particularly limited because the higher the value, the higher the toner strength and the easier it is to prevent cracking of the toner. However, where the upper limit is higher than 1.80 mN, the trailing edge offset tends to occur. Therefore, the load corresponding to the yield point is preferably 1.80 mN or less, more preferably 1.50 mN or less.

The numerical ranges of the yield point can be arbitrarily combined. The numerical range of the yield point can be controlled by adjusting the types and amounts of the binder resin, the crystalline material D, and the crystalline material E, and the area ratio A1 described later.

By increasing the load corresponding to the yield point as described above, cracking and crushing of the toner can be prevented. In the present disclosure, by designing the toner so that the inside is easily melted, it is possible to remarkably prevent the occurrence of trailing edge offset, which is an index of low-temperature fixability, even in a high-humidity environment, in combination with preventing the cracking and crushing of the toner.

Specifically, the present inventors studied viscoelastic properties of toners in order to design a toner for which the trailing edge offset in a high-humidity environment can be prevented.

Powder dynamic viscoelasticity measurement (hereinafter, also referred to as DMA) is a method capable of measuring the viscoelastic properties of a toner as a powder. As a result of the study conducted by the present inventors, it was found that where a powder dynamic viscoelasticity measurement method is used, a measurement start temperature is set to 25° C., and a ramp rate is set to 20° C./min, on a curve of a storage elastic modulus E' (Pa) where the temperature (° C.) is plotted against the abscissa and the storage elastic modulus E' is plotted against the ordinate, the temperature at the time when the storage elastic modulus E' at the start of the measurement has decreased by 50% can be used for verifying the toner viscoelasticity at the time of fixing.

In the conventional viscoelasticity measurement, it is common to perform measurement after molding the toner with heat or pressure, so the measurement result can be said to represent the viscoelastic characteristic averaged over the entire toner and is not considered to be capable of representing the characteristics of the toner at the time of fixing. Meanwhile, it is considered that since the powder dynamic viscoelasticity measurement can measure the toner in the state of powder, the results can satisfactorily reflect the state at the time of fixing the toner.

As described above, the toner on the paper with a full-surface solid black image fixed at the lowest temperature at which the trailing edge offset does not occur is fixed in a state where the lumps are melted and connected while about 50% thereof remains intact, and the particles of the toner are not sufficiently bonded. As a result of further investigation, it was found that on a curve of a storage elastic modulus E' obtained by powder dynamic viscoelasticity measurement, the temperature at the time when the storage elastic modulus E' at the start of the measurement has decreased by 50% is the temperature at which the elastic modulus of the toner decreases and the toner starts gaining viscosity. It was found that at this time, adhesion occurs between the particles of the toner which correlates well with the minimum temperature at which the trailing edge offset does not occur.

The temperature at the time when the storage elastic modulus E' at the start of the measurement has decreased by 50% is from 60° C. to 90° C. Within this range, the melting of the toner occurs at a lower temperature, and the occurrence of the trailing edge offset is prevented. When the temperature is lower than 60° C., the storage stability is reduced, the brittle fracture of the toner itself is likely to occur, and fogging occurs after long-term use. Meanwhile, when the temperature is higher than 90° C., the toner does not melt at a lower temperature, and a trailing edge offset occurs.

The temperature at the time when the storage elastic modulus E' at the start of the measurement has decreased by 50% is preferably from 70° C. to 84° C., and more preferably from 74° C. to 80° C.

The temperature at the time when the storage elastic modulus E' at the start of the measurement has decreased by 50% can be controlled by adjusting types and amounts of the binder resin, the crystalline material D and the crystalline material E, and the area ratio A1 described hereinbelow.

The toner particle includes a binder resin. The amount of the binder resin is preferably from 45% by mass to 70% by mass, and more preferably from 50% by mass to 65% by mass, based on the toner particle.

The binder resin is not particularly limited, and a known resin for toner can be used. The binder resin preferably includes the resin B, more preferably includes the resin B in an amount of 50% by mass or more, and further preferably includes the resin B in an amount of 100% by mass.

In addition, the resin B is preferably an amorphous resin.

When the dipole interaction term of Hansen solubility parameter of the resin B is taken as b (unit: $MPa^{1/2}$), the b is preferably from 1.0 to 3.5, and more preferably from 1.2 to 1.5. The b can be controlled by changing the types of monomers constituting the resin B.

Here, "the dipole interaction term of Hansen solubility parameter" means a polarization term δp (unit: $MPa^{1/2}$) representing the energy from dipolar interaction among three parameters constituting the Hansen solubility parameters.

As the resin B, for example, a vinyl resin is used.

Monomers usable in the production of the vinyl resin, that is, polymerizable monomers capable of forming the vinyl resin, can be exemplified by the following monomers. The following monomers may be used alone or in combination of two or more.

Aliphatic vinyl hydrocarbons: alkenes, for example, ethylene, propylene, butene, isobutylene, pentene, heptene, diisobutylene, octene, dodecene, octadecene, and other α-olefins; alkadienes, for example, butadiene, isoprene, 1,4-pentadiene, 1,6-hexadiene, and 1,7-octadiene.

Alicyclic vinyl hydrocarbons: mono- or di-cycloalkenes and alkadienes, for example, cyclohexene, cyclopentadiene, vinylcyclohexene, ethylidene bicycloheptene; terpenes, for example, pinene, limonene, and indene.

Aromatic vinyl hydrocarbons: styrene and hydrocarbyl (alkyl, cycloalkyl, aralkyl and/or alkenyl) substituents thereof, for example, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene; and vinylnaphthalene.

Carboxy group-including vinyl monomers and metal salts thereof: unsaturated monocarboxylic acids having from 3 to 30 carbon atoms, unsaturated dicarboxylic acids, anhydrides thereof and monoalkyl (from 1 to 27 carbon atoms) esters thereof. For example, acrylic acid, methacrylic acid, maleic acid, maleic anhydride, monoalkyl esters of maleic acid, fumaric acid, monoalkyl esters of fumaric acid, crotonic acid, itaconic acid, monoalkyl esters of itaconic acid, glycol monoethers of itaconic acid, citraconic acid, monoalkyl esters of citraconic acid, and carboxy group-including vinyl monomers of cinnamic acid.

Vinyl esters, for example, vinyl acetate, vinyl butyrate, vinyl propionate, vinyl butyrate, diallyl phthalate, diallyl adipate, isopropenyl acetate, vinyl methacrylate, methyl 4-vinyl benzoate, cyclohexyl methacrylate, benzyl methacrylate, phenyl acrylate, phenyl methacrylate, vinyl methoxyacetate, vinyl benzoate, ethyl α-ethoxy acrylate, alkyl acrylates and alkyl methacrylates having an alkyl group (linear or branched) having from 1 to 22 carbon atoms (methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, behenyl methacrylate, and the like), dialkyl fumarates (dialkyl esters of fumaric acid, the two alkyl groups are each independently a linear, branched or alicyclic group having from 2 to 8 carbon atoms), dialkyl maleates (dialkyl esters of maleic acid, the two alkyl groups are each independently a linear, branched or alicyclic group having from 2 to 8 carbon atoms), polyallyloxyalkanes (diallyloxyethane, triallyloxyethane, tetraallyloxyethane, tetraallyloxypropane, tetraallyloxybutane, and tetramethallyloxyethane), vinyl monomers having a polyalkylene glycol chain (polyethylene glycol (molecular weight 300) monoacrylate, polyethylene glycol (molecular weight 300) monomethacrylate, polypropylene glycol (molecular weight 500) monoacrylate, polypropylene glycol (molecular weight 500) monomethacrylate, methyl alcohol ethylene oxide (ethylene oxide is hereinafter abbreviated as EO) 10 mol adduct acrylate, methyl alcohol ethylene oxide 10 mol adduct methacrylate, lauryl alcohol EO 30 mol adduct acrylate, and lauryl alcohol EO 30 mol methacrylate), polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

Carboxy group-including vinyl esters: for example, carboxyalkyl acrylates having an alkyl chain having from 3 to 20 carbon atoms, and carboxyalkyl methacrylates having an alkyl chain having from 3 to 20 carbon atoms.

As the monomer usable for the production of the vinyl resin, that is, the polymerizable monomer capable of forming the vinyl resin, acrylonitrile and the like can be used in addition to the above monomers.

The toner particle preferably includes a colorant. Examples of the colorants include pigments, dyes, magnetic bodies, and the like. These can be used alone or in combination of two or more.

Examples of black pigments include carbon black such as furnace black, channel black, acetylene black, thermal black, lamp black, and the like. These can be used alone or in combination of two or more.

Pigments or dyes can be used as a colorant suitable for yellow color. Examples of the pigments include C. I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183 and 191, as well as C. I. Vat Yellow 1, 3 and 20. Examples of the dyes include C. I. Solvent Yellow 19, 44, 77, 79, 81, 82, 93, 98, 103, 104, 112 and 162. These can be used alone or in combination of two or more.

Pigments or dyes can be used as a colorant suitable for cyan color. Examples of the pigments include C. I. Pigment Blue 1, 7, 15, 15;1, 15;2, 15;3, 15;4, 16, 17, 60, 62 and 66, C. I. Vat Blue 6, as well as C. I. Acid Blue 45. Examples of the dyes include C. I. Solvent Blue 25, 36, 60, 70, 93 and 95. These can be used alone or in combination of two or more.

Pigments or dyes can be used as a colorant suitable for magenta color. Examples of the pigments include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48;2, 48;3, 48;4, 49, 50, 51, 52, 53, 54, 55, 57, 57;1, 58, 60, 63, 64, 68, 81, 81;1, 83, 87, 88, 89, 90, 112, 114, 122, 123, 144, 146, 150, 163, 166, 169, 177, 184, 185, 202, 206, 207, 209, 220, 221, 238 and 254, C. I. Pigment Violet 19, as well as C. I. Vat Red 1, 2, 10, 13, 15, 23, 29 and 35.

Examples of the dyes for magenta include oil soluble dyes such as C. I. Solvent Red 1, 3, 8, 23, 24, 25, 27, 30, 49, 52, 58, 63, 81, 82, 83, 84, 100, 109, 111, 121 and 122, C. I. Disperse Red 9, C. I. Solvent Violet 8, 13, 14, 21 and 27, as well as C. I. Disperse Violet 1, basic dyes such as C. I. Basic Red 1, 2, 9, 12, 13, 14, 15, 17, 18, 22, 23, 24, 27, 29, 32, 34, 35, 36, 37, 38, 39 and 40, C. I. Basic Violet 1, 3, 7, 10, 14, 15, 21, 25, 26, 27 and 28. These can be used alone or in combination of two or more.

The toner particle preferably includes a magnetic body as a colorant.

Examples of the magnetic body include iron oxides such as magnetite, maghemite, ferrite, and the like; metals such as iron, cobalt, and nickel; or alloys or mixtures of these metals and aluminum, copper, magnesium, tin, zinc, beryllium, calcium, manganese, selenium, titanium, tungsten, and vanadium.

The number-average particle diameter of primary particles of the magnetic bodies is preferably 500 nm or less, more preferably from 50 nm to 350 nm.

The number-average particle diameter of primary particles of the magnetic bodies present in the toner particle can be measured using a transmission electron microscope.

Specifically, after the toner to be observed is sufficiently dispersed in an epoxy resin, the toner is cured in an atmosphere at a temperature of 40° C. for 2 days to obtain a cured product. The cured product is used as a flaky sample obtained with a microtome, an image with a magnification of from 10,000 to 40,000 times is captured with a transmission electron microscope (hereinafter also referred to as a TEM), and the projected area of primary particles of 100 magnetic bodies in the image is measured. The equivalent diameter of a circle equal to the projected area is defined as a particle diameter of the primary particle of the magnetic body, and the average value of the 100 particles is defined as the number-average particle diameter of the primary particles of the magnetic bodies.

The amount of the magnetic bodies with respect to 100.0 parts by mass of the binder resin or the polymerizable monomer capable of forming the binder resin is preferably from 35.0 parts by mass to 100.0 parts by mass, more preferably from 45.0 parts by mass to 90.0 parts by mass, and even more preferably from 50.0 parts by mass to 70.0 parts by mass.

Where the amount of the magnetic bodies is within the above range, the magnetic attraction with the magnet roll in the developing sleeve becomes appropriate. Further, the hardness of the toner surface becomes appropriate, and the load corresponding to the yield point can be easily adjusted within the above range.

The amount of the magnetic bodies in the toner can be measured using a thermal analyzer TGA Q5000IR manufactured by Perkin Elmer Corp. In the measurement, a magnetic toner is heated from normal temperature to 900° C. at a ramp rate of 25° C./min in a nitrogen atmosphere, the mass loss from 100° C. to 750° C. is taken as the mass of the components after excluding the magnetic bodies from the toner, and the remaining mass is taken as the mass of the magnetic bodes.

The magnetic bodies can be manufactured, for example, by the following method.

An alkali such as sodium hydroxide is added to the aqueous ferrous salt solution in an amount equivalent to or more than the iron component to prepare an aqueous solution including ferrous hydroxide. Air is blown in while maintaining the pH of the prepared aqueous solution at 7 or more, and an oxidation reaction of ferrous hydroxide is performed while heating the aqueous solution to 70° C. or more to first generate seed crystals serving as cores of magnetic iron oxide.

Next, an aqueous solution including about 1 equivalent of ferrous sulfate is added to the slurry liquid including the seed crystals based on the amount of the alkali added before. The pH of the mixture is maintained at from 5 to 10, the reaction of ferrous hydroxide is advanced while blowing air, and magnetic iron oxide is grown around the seed crystals. At this time, the shape and magnetic properties of the magnetic bodies can be controlled by selecting arbitrary pH, reaction temperature, and stirring conditions. As the oxidation reaction proceeds, the pH of the mixed solution shifts to the acidic side, but the pH of the mixed solution is preferably 5 or more. The magnetic bodies can be obtained by filtering, washing and drying the magnetic bodies thus obtained by established methods.

The toner particle preferably includes a surface-treated magnetic body A having a magnetic body and a hydrophobic treatment agent including an organic compound having a hydrophobic group on the surface of the magnetic body.

The surface-treated magnetic body A is obtained by surface-treating with the hydrophobic treatment agent including an organic compound having a hydrophobic group.

The hydrophobic group can be, for example, a hydrocarbon group having from 8 to 16 carbon atoms.

When the dipole interaction term of Hansen solubility parameter of the surface-treated magnetic body A is taken as a (unit: $MPa^{1/2}$), a is preferably from 1.40 to 2.10, more preferably from 1.70 to 2.04, and even more preferably from 1.80 to 2.00. The value of a can be controlled by changing the type of the hydrophobic treatment agent.

Examples of the organic compound having the hydrophobic group include silane compounds having a hydrocarbon group having from 8 to 16 carbon atoms. Examples of the silane compound include a silane coupling agent.

The silane coupling agent is more preferably an alkyltrialkoxysilane coupling agent represented by a following formula (I).

$$C_pH_{2p+1}—Si—(OC_qH_{2q+1})_3 \quad (I)$$

In the formula (I), p represents an integer of from 8 to 16, and q represents an integer of from 1 to 3.

Where p in the formula (I) is 8 or more, sufficient hydrophobicity can be imparted. It is preferable that p be made 16 or less because the surface of the magnetic body can be uniformly treated, and coalescence of the magnetic bodies can be prevented.

By treating with the hydrophobic treatment agent by, for example, a treatment method described later, the hydrophobicity can be increased even in a state where a hydroxyl group is partially left on the surface of the magnetic body.

The carbon amount derived from the silane compound in the surface-treated magnetic body A is preferably less than 0.5% by mass, and more preferably 0.4% by mass or less. The carbon content is preferably 0.2% by mass or more.

The above numerical ranges can be arbitrarily combined. Further, the above numerical ranges can be adjusted by changing the surface treatment method of the magnetic body and the addition amount of the hydrophobic treatment agent.

The surface of the magnetic body can be treated, for example, by the following method, but this method is not limiting.

For the purpose of uniformly reacting the hydrophobic treatment agent on the particle surface of the magnetic body to express high hydrophobicity, and at the same time, partially leaving the hydroxyl groups on the particle surface of the magnetic body without complete hydrophobization, it is preferable that the surface treatment be performed in a dry manner using a wheel-type kneader or a grinder.

Here, a Mix-Muller, a Multi-Mul, a Stotts mill, a backflow kneader, an Erich-mill, or the like can be adopted as the wheel-type kneader, and it is preferable to use the Mix-Muller.

When a wheel-type kneader or a grinder is used, three functions of a compression action, a shearing action, and a spatula action can be exhibited.

The hydrophobic treatment agent present between the particles of the magnetic bodies is pressed against the surface of the magnetic bodies by the compression action, so that the adhesion and the reactivity with the particle surface can be enhanced. By applying a shear force to each of the hydrophobic treatment agent and the magnetic body by a shearing action, the hydrophobic treatment agent can be stretched and the particles of the magnetic body can be broken apart to release aggregates. Further, with the spatula action, the hydrophobic treatment agent present on the surface of the magnetic particles can be spread evenly as if by a spatula.

As a result of continuously and repeatedly demonstrating the above three actions, the surface of each magnetic body particle can be uniformly treated while breaking apart the particle aggregates and separating into individual particles without re-aggregation.

Usually, the hydrophobic treatment agent represented by the formula (I) and having a relatively large number of carbon atoms is unlikely to treat the particle surface of the magnetic body uniformly at the molecular level because the molecule of the agent is large and bulky, but the treatment by the above method is preferable because the treatment can be performed stably.

When the surface treatment of the magnetic body is performed by a wheel-type kneader or a grinder by using a hydrophobic treatment agent represented by the formula (I), the particle surface of the magnetic body on which portions that have reacted with the hydrophobic treatment agent and hydroxyl groups that remained unreacted are alternately present and co-present can be achieved.

By setting the particle surface of the magnetic body in such a state, it is possible to impart a constant water absorbing property while increasing the hydrophobicity. Further, by such a method, for example, the dipole interaction term a of Hansen solubility parameter of the surface-treated magnetic body A can be adjusted to be within the above range.

Meanwhile, when the surface treatment is performed by a wet method such as paddle stirring or the like, it is difficult to obtain the above-described compressing action and shearing action, and it is difficult to exert the water absorbing property.

A constant water absorbing property is likewise difficult to exhibit also when the surface treatment is performed with a device having only a stirring action such as a Henschel mixer or the like, although this is a dry treatment.

The toner particle preferably includes a resin C in addition to the binder resin.

Further, the resin C is preferably an amorphous resin.

Here, the amorphous resin is a resin for which a distinct endothermic peak (melting point) is not observed in differential scanning calorimetry (DSC).

Where the dipole interaction term of Hansen solubility parameter of the resin C is taken as c (unit: $MPa^{1/2}$), the c is preferably from 5.80 to 6.60, and more preferably from 6.00 to 6.30. The c can be controlled by changing the types of monomers that form the resin C.

The glass transition temperature (Tg) of the resin C is preferably from 60.0° C. to 90.0° C., and more preferably from 70.0° C. to 82.0° C.

The resin C is preferably an amorphous polyester resin, and is also preferably an amorphous polyester resin including an isosorbide unit represented by the following formula (1).

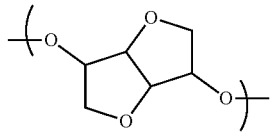

(1)

It is more preferable that the resin C be an amorphous polyester resin including the isosorbide unit, since the affinity between the surface-treated magnetic body A and the resin C increases. This is apparently because isosorbide has a structure in which oxygen atoms are more outwardly directed than in the conventionally used alcohol monomers (for example, an alkylene oxide adduct of bisphenol A), so that hydrogen bonds are easily formed with the surface-treated magnetic body A.

It is preferable than the amount of the isosorbide unit in the resin C be from 0.1 mol % to 30.0 mol % because the above-described effect of hydrogen bonding is more prominent, and the affinity with the surface-treated magnetic body A tends to be higher. It is also preferable that the amount of the isosorbide unit in the resin C be 30.0 mol % or less because the developing performance is easily maintained even under high temperature and high humidity. The amount of the isosorbide unit in the resin C is more preferably from 0.1 mol % to 5.0 mol %.

An amorphous polyester resin can be prepared by polycondensation of a polyvalent carboxylic acid (divalent or trivalent or higher carboxylic acid), an anhydride or lower alkyl ester thereof, and a polyhydric alcohol (dihydric or trihydric or higher alcohol). When the polyhydric alcohol includes isosorbide, an amorphous polyester resin including an isosorbide unit represented by the above formula (1) can be obtained. Specifically, such resin can be prepared by a method of dehydration condensation at a reaction temperature of 180° C. to 260° C. in a nitrogen atmosphere at a composition ratio in which a carboxyl group remains.

Examples of monomers that can be used in the production of the amorphous polyester resin include conventionally known divalent or trivalent or higher carboxylic acids and conventionally known dihydric or trihydric or higher alcohols. Specific examples of these monomers are listed hereinbelow.

Examples of divalent carboxylic acids include dicarboxylic acids such as oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, phthalic acid, isophthalic acid, terephthalic acid, dicarboxylic acids such as dodecenyl succinic acid, anhydrides thereof or lower alkyl esters thereof, and aliphatic unsaturated dicarboxylic acids such as maleic acid, fumaric acid, itaconic acid, citraconic acid, and the like. Lower alkyl esters and acid anhydrides of these dicarboxylic acids can also be used.

Examples of the trivalent or higher carboxylic acid include 1,2,4-benzenetricarboxylic acid, 1,2,5-benzenetricarboxylic acid, anhydrides thereof, lower alkyl esters thereof, and the like.

These may be used alone or in combination of two or more.

Examples of the dihydric alcohols include alkylene glycols (1,2-ethanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediols, and 1,20-icosanediol); alkylene ether glycols (polyethylene glycol and polypropylene glycol); alicyclic diols (1,4-cyclohexanedimethanol); bisphenols (bisphenol A); alkylene oxide (ethylene oxide and propylene oxide) adducts of alicyclic diols, and alkylene oxides (ethylene oxide and propylene oxide) adducts of bisphenols (alkylene oxide adducts of bisphenol A).

The alkyl segment of the alkylene glycol and the alkylene ether glycol may be linear or branched. An alkylene glycol having a branched structure can also be preferably used.

Also, an aliphatic diol having a double bond can be used. Examples of the aliphatic diol having a double bond include the following compounds.

2-Butene-1,4-diol, 3-hexene-1,6-diol, and 4-octene-1,8-diol.

Also, examples of the trivalent or higher alcohol include glycerin, trimethylolethane, trimethylolpropane, pentaerythritol, and the like.

These may be used alone or in combination of two or more.

A monovalent acid such as acetic acid, benzoic acid, and the like, and a monohydric alcohol such as cyclohexanol, benzyl alcohol, and the like can be used as needed for the purpose of adjusting the acid value and the hydroxyl value.

It is preferable that the alcohol component include at least one selected from the group consisting of bisphenols and alkylene oxides of bisphenols.

The amount of the resin C is preferably from 1.5 parts by mass to 10.0 parts by mass, and more preferably from 3.0 parts by mass to 6.0 parts by mass with respect to 100.0 parts by mass of the binder resin or a polymerizable monomer capable of forming the binder resin.

It is preferable that the toner particle include a crystalline material D.

When the dipole interaction term of Hansen solubility parameter of the crystalline material D is taken as d (unit: $MPa^{1/2}$), the d is preferably from 0.50 to 2.50, and more preferably from 1.10 to 2.10. The d can be controlled by changing the type of the monomers constituting the crystalline material D.

The melting point of the crystalline material D is preferably from 60.0° C. to 75.0° C., and more preferably from 65.0° C. to 70.0° C.

From the viewpoint of low-temperature fixability, it is preferable that the crystalline material D include a crystalline polymer compound having an ester bond.

The amount of the crystalline material D may be from 2.0 parts by mass to 35.0 parts by mass, and more preferably from 5.0 parts by mass to 30.0 parts by mass with respect to 100.0 parts by mass of the binder resin or a polymerizable monomer capable of forming the binder resin.

The crystalline material D may include a wax having an ester bond.

Here, the wax is a wax for which a distinct endothermic peak (melting point) is observed in differential scanning calorimetry (DSC).

The wax is not particularly limited as long as it has an ester bond and crystallinity, and a known wax may be used. Examples of the wax include natural waxes such as carnauba wax, candelilla wax, and the like and derivatives thereof, and ester waxes.

Here, derivatives include oxides, block copolymers with vinyl monomers, and graft-modified products.

Examples of the ester wax include a monoester compound having one ester bond in one molecule, and polyfunctional ester compounds such as diester compounds having two ester bonds in one molecule, tetrafunctional ester compounds having four ester bonds in one molecule, hexafunctional ester compounds having six ester bonds in one molecule, and the like.

The wax preferably includes at least one compound selected from the group consisting of a monoester compound and a diester compound.

Among them, the monoester compound is more excellent in low-temperature fixability because the ester compound tends to be linear and has high compatibility with the styrene resin.

Specific examples of the monoester compound include waxes mainly including a fatty acid ester such as carnauba wax, montanic acid ester wax, and the like; compounds obtained by partial or complete removal of acid component from such aliphatic esters, such as deoxidized carnauba wax and the like; compounds obtained by subjecting vegetable oils to hydrogenation or the like; methyl ester compounds having a hydroxy group; and saturated fatty acid monoesters such as stearyl stearate, behenyl stearate, behenyl behenate, and the like.

Specific examples of the diester compound include dibehenyl sebacate, nonanediol dibehenate, behenate terephthalate, stearyl terephthalate, and the like.

In addition, one kind of the wax may be used alone, or two or more kinds may be used in combination.

In addition, from the viewpoint of low-temperature fixability, the crystalline material D may include a crystalline polyester.

The crystalline polyester is a polyester for which a distinct endothermic peak (melting point) is observed in differential scanning calorimetry (DSC).

The crystalline polyester can be exemplified by a condensation polymer of an alcohol component including an aliphatic diol and an acid component including an aliphatic dicarboxylic acid.

Among them, a condensation polymer of an alcohol component including an aliphatic diol having from 2 to 12 carbon atoms and an acid component including an aliphatic dicarboxylic acid having from 2 to 12 carbon atoms is preferable.

Examples of the aliphatic diol having from 2 to 12 carbon atoms include the following compounds.

1,2-Ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, and 1,12-dodecanediol.

Further, an aliphatic diol having a double bond can be used. Examples of the aliphatic diol having a double bond include the following compounds.

2-Butene-1,4-diol, 3-hexene-1,6-diol, and 4-octene-1,8-diol.

Examples of the aliphatic dicarboxylic acid having from 2 to 12 carbon atoms include the following compounds.

Oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, and 1,12-dodecanedicarboxylic acid. Lower alkyl esters and acid anhydrides of these aliphatic dicarboxylic acids can also be used.

Of these, sebacic acid, adipic acid, and 1,10-decanedicarboxylic acid, and their lower alkyl esters and acid anhydrides are preferred. These may be used alone or as a mixture of two or more.

Further, an aromatic dicarboxylic acid can also be used. Examples of the aromatic dicarboxylic acid include the following compounds.

Terephthalic acid, isophthalic acid, 2,6-naphthalenedicarboxylic acid and 4,4'-biphenyldicarboxylic acid.

Among these, terephthalic acid is preferred because it is easily available and easily forms a polymer having a low melting point.

Furthermore, a dicarboxylic acid having a double bond can also be used. A dicarboxylic acid having a double bond can be suitably used to prevent hot offset at the time of fixing because the entire resin can be crosslinked by utilizing the double bond of the acid.

The dicarboxylic acid can be exemplified by fumaric acid, maleic acid, 3-hexenedioic acid, and 3-octenedioic acid. Other examples include lower alkyl esters and acid anhydrides thereof. Among these, fumaric acid and maleic acid are preferred.

The method for producing the crystalline polyester is not particularly limited, and the crystalline polyester can be produced by a general polyester polycondensation method in which an acid component and an alcohol component are reacted. Depending on the type of the monomer, the crystalline polyester can be produced by using, for example, a direct polycondensation method or a transesterification method.

The toner particle preferably includes a crystalline material E.

Where the dipole interaction term of Hansen solubility parameter of the crystalline material E is taken as e (unit: $MPa^{1/2}$), the e is preferably from 0.00 to 1.50, and more preferably from 0.00 to 0.50. The e can be controlled by changing the types of monomers constituting the crystalline material E.

The melting point of the crystalline material E is preferably from 65.0° C. to 80.0° C., and more preferably from 68.0° C. to 77.0° C.

The crystalline material E can be exemplified by petroleum waxes such as paraffin wax, microcrystalline wax, petrolactam, and the like and derivatives thereof, hydrocarbon waxes obtained by Fischer-Tropsch method and derivatives thereof, polyolefin waxes represented by polyethylene and polypropylene, and derivatives thereof.

Of these, paraffin wax is preferred. When the crystalline material E is paraffin wax, the releasability between the fixing film and the toner during film fixing is improved. Specific examples of the paraffin wax include, but are not limited to, HNP-51 (manufactured by Nippon Seiro Co., Ltd.).

The amount of the crystalline material E is preferably 5.0 parts by mass or less, and more preferably 3.0 parts by mass or less based on 100.0 parts by mass of the binder resin or a polymerizable monomer capable of forming the binder resin. Further, the amount of the crystalline material E is preferably 1.0 part by mass or more. The numerical ranges can be arbitrarily combined. When the amount of the crystalline material E is within this range, migration to the toner surface can be prevented while ensuring releasability during fixing.

A method for producing a toner of the present disclosure is, a method for producing a toner comprising a toner particle including a binder resin, the method comprising:

a step (I) of dispersing a polymerizable monomer composition including a polymerizable monomer capable of forming the binder resin in an aqueous medium, and forming particles of the polymerizable monomer composition in the aqueous medium, and a step (II) of polymerizing the polymerizable monomer included in the particles of the polymerizable monomer composition, wherein the toner is such that (1) when a powder dynamic viscoelasticity measurement method is used, a measurement start temperature is set to 25° C., and a ramp rate is set to 20° C./min, on a curve of a storage elastic modulus E' (Pa) where a temperature (° C.) is plotted against an abscissa and the storage elastic modulus E' is plotted against an ordinate, a temperature at a time when the storage elastic modulus E' at a start of a measurement has decreased by 50% is from 60° C. to 90° C., and (2) a load at a yield point of a displacement-load curve which is determined by a nanoindentation method and where a load (mN) is plotted against an ordinate and a displacement amount (μm) is plotted against an abscissa, is 0.80 mN or more.

Here, the relationship between the raw materials constituting the toner particle will be described.

The toner particle preferably includes the resin C, and the binder resin preferably includes the resin B.

Regarding the production method, the polymerizable monomer preferably includes a polymerizable monomer b capable of forming the resin B, and the polymerizable monomer composition preferably includes the surface-treated magnetic body A surface-treated with a hydrophobic treatment agent including an organic compound having a hydrophobic group.

In addition, it is preferable that the polymerizable monomer composition include the resin C.

Further, where the dipole interaction term of Hansen solubility parameter of the resin B is taken as b ($MPa^{1/2}$) and the dipole interaction term of Hansen solubility parameter of the resin C is taken as c ($MPa^{1/2}$), it is preferable that $b<c$ is satisfied.

Where the dipole interaction term of Hansen solubility parameter of the surface-treated magnetic body A is taken as a ($MPa^{1/2}$), the dipole interaction term of Hansen solubility parameter of the resin B is taken as b ($MPa^{1/2}$), and the dipole interaction term of Hansen solubility parameter of the resin C is taken as c ($MPa^{1/2}$) it is preferable that the relationship represented by the following inequality (1) be satisfied:

$$b<a<c \quad (1).$$

By controlling the dipole interaction term of Hansen solubility parameter so as to satisfy the relation of inequality (1), it is possible to arrange the resin B, the surface-treated magnetic body A, and the resin C, which constitute the toner particle, at suitable positions in the toner particle. Further, it is considered that the occurrence of fogging can be prevented while preventing the occurrence of trailing edge offset even in long-term use in a high-temperature and high-humidity environment (for example, temperature: 32.5° C. and relative humidity: 80%).

In addition, the step (I) may further include:

a step of dispersing the surface-treated magnetic body A in the polymerizable monomer b capable of forming the resin B to obtain a surface-treated magnetic body-dispersed solution, and a step of dissolving the resin C in the surface-treated magnetic body-dispersed solution to obtain a polymerizable monomer composition.

The polymerizable monomer composition may include, as needed, the crystalline material D and/or the crystalline material E.

The resin, polymerizable monomer, and magnetic body tend to be distributed non-uniformly, even if the dissolution strength is increased, due to differences in hydrophobicity and specific gravity.

By keeping the affinity balance between the resin B, the surface-treated magnetic body A, and the resin C, which form the surface layer structure of the toner particle, the surface layer of the toner can be controlled to a specific structure.

Specifically, the toner particle preferably has a core-shell structure in which the outermost layer of the toner includes the resin C, the second layer is a shell including the surface-treated magnetic body A, and the core includes the resin B.

When the above three components satisfy the relation of the inequality (1), a specific shell structure is easily formed. As a result, the load corresponding to the yield point can be easily controlled within the above range.

Next, the affinity between the raw materials constituting the toner particle will be described.

Where the dipole interaction term of Hansen solubility parameter of the surface-treated magnetic body A is taken as a ($MPa^{1/2}$), the dipole interaction term of Hansen solubility parameter of the resin B is taken as b ($MPa^{1/2}$), and the dipole interaction term of Hansen solubility parameter of the resin C is taken as c ($MPa^{1/2}$), it is preferable that following inequalities (2) and (3) be satisfied:

$$|b-a| \leq 1.10 \quad (2)$$

$$|c-a| \leq 4.60 \quad (3).$$

Regarding the inequality (2), where the value of |b−a| is equal to or less than 1.10, the affinity between the surface-treated magnetic body A and the resin B is increased, and the adhesiveness between the materials is easily increased. Therefore, deterioration of the toner can be prevented even during long-term use. The value of |b−a| is preferably 0.70 or less, more preferably 0.60 or less, and even more preferably 0.50 or less. The value of |b−a| is preferably 0.20 or more. The numerical ranges can be arbitrarily combined.

Further, regarding the inequality (3), where the value of |c−a| is equal to or less than 4.60, the affinity between the resin C and the surface-treated magnetic body A is increased, and the adhesiveness between the materials is easily increased. Therefore, deterioration of the toner can be prevented even during long-term use. The value of |c−a| is preferably 4.40 or less, more preferably 4.20 or less. The value of |c−a| is preferably 1.20 or more. The numerical ranges can be arbitrarily combined.

Where the dipole interaction term of Hansen solubility parameter of the crystalline material D is taken as d ($MPa^{1/2}$), and the dipole interaction term of Hansen solubility parameter of the surface-treated magnetic body A is taken as a ($MPa^{1/2}$), a following inequality (4) is satisfied:

$$|d-a| \leq 0.75 \quad (4).$$

By controlling the dipole interaction terms of Hansen solubility parameter so as to satisfy the relation of inequality (4), the crystalline material D can be kept inside the toner without migrating to the toner surface except during fixing. This is preferable from the viewpoint of storage stability. Preferably, |d−a|≤0.70, more preferably, |d−a|≤0.35, even more preferably, |d−a|≤0.30, and particularly preferably, |d−a|≤0.25. Further, |d−a|≥0.05 is preferable, and |d−a|≥0.10 is more preferable. The numerical ranges can be arbitrarily combined.

Where the dipole interaction term of Hansen solubility parameter of the crystalline material E is taken as e ($MPa^{1/2}$), and the dipole interaction term of Hansen solubility parameter of the surface-treated magnetic body A is taken as a ($MPa^{1/2}$), a following inequality (5) is satisfied:

$$|e-a| \geq 1.50 \quad (5).$$

Preferably, |e−a|≥1.80, more preferably, |e−a|≥2.00. It is preferable that |e−a|≤2.10. The numerical ranges can be arbitrarily combined.

In a cross section of the toner observed with a transmission electron microscope, where a number of toners having a domain of the crystalline material D having a major axis of 500 nm or more is taken as B1 and a number of toners having no domain of the crystalline material D having a major axis of 500 nm or more is taken as C1, a following inequality (6) is satisfied:

$$B1/(B1+C1) \leq 0.20 \quad (6).$$

Preferably, B1/(B1+C1) is 0.15 or less, more preferably, 0.10 or less. Preferably, B1/(B1+C1) is 0.00 or more. The numerical ranges can be arbitrarily combined.

By setting B1/(B1+C1) to 0.20 or less, the number of domains of the crystalline material D having a small interface with the binder resin is reduced, and efficient fixing is possible. As a result, low-temperature fixability and gloss uniformity are improved. B1/(B1+C1) can be controlled by changing the type or combination of the crystalline material D, or by producing toner particles by using a production method in which the crystalline material D is rapidly cooled and crystallized from a state in which the crystalline material D is compatible with the binder resin.

In a cross section of the toner observed with a transmission electron microscope, where an area ratio occupied by the surface-treated magnetic body A in a range from a contour of the cross section of the toner particle to 200 nm or less in the direction of a center of gravity of the toner particle in the cross section is taken as A1, the area ratio A1 is preferably 35% or more, more preferably 38% or more, and even more preferably 45% or more. Further, the area ratio A1 is preferably 80% or less, and more preferably 75% or less. The numerical ranges can be arbitrarily combined. The area ratio A1 can be, for example, from 35% to 80%.

Where the area ratio A1 is 35% or more, the load corresponding to the yield point is easily adjusted to the above range, and the brittle fracture of the toner itself is easily prevented. Meanwhile, where the area ratio A1 is 80% or less, the low-temperature fixability is not easily inhibited. When the area ratio is in the above range, both low-temperature fixability and durability can be achieved at a high level.

The area ratio A1 can be controlled by changing the number of magnetic bodies, the type of medium at the time of toner production, the type of magnetic body, and the type of surface treatment agent.

The toner particles may include a charge control agent. The toner is preferably a negatively chargeable toner.

As the charge control agent for negative charge, an organometallic complex compound and a chelate compound are effective, and examples thereof include a monoazo metal complex compound; an acetylacetone metal complex compound; a metal complex compound of an aromatic hydroxycarboxylic acid or an aromatic dicarboxylic acid, and the like.

Specific examples of commercially available products include Spilon Black TRH, T-77, T-95 (Hodogaya Chemical Industry Co., Ltd.) and BONTRON® S-34, S-44, S-54, E-84, E-88, and E-89 (Orient Chemical Industry Co., Ltd.).

The charge control agents can be used alone or in combination of two or more.

From the viewpoint of charge quantity, the amount of the charge control agent is preferably from 0.1 part by mass to 10.0 parts by mass, and more preferably from 0.1 part by mass to 5.0 parts by mass with respect to 100.0 parts by mass of the binder resin or a polymerizable monomer capable of forming the binder resin.

The toner particle may include a crosslinking agent. The preferable addition amount of the crosslinking agent is from 0.01 part by mass to 5.00 parts by mass with respect to 100.0 parts by mass of the polymerizable monomer capable of forming the binder resin.

As the cross-linking agent, a compound having two or more polymerizable double bonds can be mainly used. Specifically, for example, aromatic divinyl compounds such as divinylbenzene, divinylnaphthalene, and the like; carboxylic acid esters having two double bonds, such as ethylene glycol diacrylate, ethylene glycol dimethacrylate, 1,3-butanediol dimethacrylate, 1,6-hexanediol diacrylate, and the like; divinyl compounds such as divinylaniline, divinyl ether, divinyl sulfide, divinyl sulfone, and the like; and compounds having three or more vinyl groups can be used. These may be used alone or as a mixture of two or more.

The method for producing the toner is not limited to the above-described suspension polymerization method, and any of a dry production method (for example, a kneading and pulverizing method and the like) and a wet production method (for example, an emulsion aggregation method, a solution suspension method, and the like) may be used.

Among them, it is preferable to use the suspension polymerization method described above. Specifically, for example, the following production method can be used, but this production method is not limiting.

In the production of toner particles by the suspension polymerization method, a polymerization initiator may be used. A polymerization initiator having a half-life of from 0.5 h to 30 h during the polymerization reaction is preferable. Further, the polymerization initiator is preferably used in an addition amount of from 0.5 part by mass to 20 parts by mass with respect to 100 parts by mass of the polymerizable monomer. In this case, a polymer having a maximum molecular weight between 5,000 and 50,000 can be obtained, and the toner particle can have preferable strength and appropriate melting characteristics.

Specific examples of polymerization initiators include azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and the like; and peroxide-based polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butylperoxy 2-ethylhexanoate, t-butylperoxypivalate, di(2-ethylhexyl) peroxydicarbonate, di(secondary butyl) peroxydicarbonate, and the like.

Among them, t-butyl peroxypivalate is preferred.

The aqueous medium in which the polymerizable monomer composition is to be dispersed may include a dispersion stabilizer. As the dispersion stabilizer, known surfactants, organic dispersants and inorganic dispersants can be used. Among them, inorganic dispersants are preferred because they have dispersion stability owing to their steric hindrance, so that even if the reaction temperature is changed, the stability is hardly lost, the washing is easy, and the toner is hardly adversely affected thereby.

Examples of such inorganic dispersants include polyvalent metal phosphates such as trisodium phosphate, tricalcium phosphate, magnesium phosphate, aluminum phosphate, zinc phosphate, hydroxyapatite, and the like; carbonates such as calcium carbonate, magnesium carbonate, and the like; inorganic salts such as calcium metasilicate, calcium sulfate, barium sulfate, calcium chloride, and the like; and inorganic compounds such as calcium hydroxide, magnesium hydroxide, aluminum hydroxide, and the like.

These inorganic dispersants are preferably used in an amount of from 0.2 part by mass to 20 parts by mass with respect to 100 parts by mass of the polymerizable monomer. Further, the dispersion stabilizers may be used alone or in combination of two or more. Further, a surfactant may be used in combination in an amount of from 0.001 part by mass to 0.1 part by mass. When these inorganic dispersants are to be used, they may be used as they are, but in order to obtain finer particles, the inorganic dispersant particles can be generated and used in an aqueous medium.

For example, in the case of tricalcium phosphate, an aqueous solution of sodium phosphate and an aqueous solution of calcium chloride can be mixed under high-speed stirring to produce water-insoluble calcium phosphate, and more uniform and fine dispersion can be achieved. At this time, a water-soluble sodium chloride salt is by-produced at the same time, but it is preferable that a water-soluble salt be present in the aqueous medium, because the dissolution of the polymerizable monomer in water is prevented and an ultrafine toner is unlikely to be generated by emulsion polymerization.

Examples of the surfactant include sodium dodecylbenzene sulfate, sodium tetradecyl sulfate, sodium pentadecyl sulfate, sodium octyl sulfate, sodium oleate, sodium laurate, sodium stearate, potassium stearate, and the like.

In the step of polymerizing the polymerizable monomer, the polymerization temperature is usually set to 40° C. or higher, preferably from 50° C. to 90° C. When the polymerization is carried out in this temperature range, the release agent to be sealed inside is precipitated by phase separation, and the encapsulation becomes more complete.

Thereafter, a cooling step of cooling from a reaction temperature of about from 50° C. to 90° C. is performed to terminate the polymerization reaction step.

Here, the presence state of the domain of the crystalline material D having a specific long diameter in the cross section of the toner observed with a transmission electron microscope can be easily controlled to the above-described range by using a method described below.

For example, after polymerizing the polymerizable monomer to obtain resin particles, the temperature of the dispersion in which the resin particles are dispersed in the aqueous medium is raised to a temperature exceeding the melting point of the crystalline material D. However, where the polymerization temperature exceeds the melting point, this operation is not necessary.

After raising the temperature, a cooling step may be implemented by cooling the dispersion to around room temperature at a cooling rate of from 3° C./min to 200°

C./min (preferably from 3° C./min to 150° C./min) in order to increase the crystallinity of the crystalline material D.

By cooling at the specific speed, a toner satisfying the inequality (6) can be easily produced.

After the cooling step, the dispersion may be heated to about 50° C. and subjected to a heat treatment.

The heat treatment is preferably performed for about form 1 h to 24 h, more preferably for about from 2 h to 10 h.

After completion of the polymerization of the polymerizable monomer, the obtained polymer particles are filtered, washed and dried by known methods to obtain toner particles.

A toner can be obtained by mixing an external additive described below with the toner particles and attaching the external additive to the surface of the toner particles. Further, the obtained toner particles can be directly used as a toner. It is also possible to introduce a classification step in the production process to cut coarse powder and fine powder included in the toner particles.

The toner particles may be mixed, if necessary, with an external additive to improve the flowability and/or the charging performance of the toner to form a magnetic toner. A known device such as a Henschel mixer may be used for mixing the external additive.

Examples of the external additive include inorganic fine particles having a number-average particle diameter of primary particles of from 4 nm to 80 nm, and more preferably inorganic fine particles having a number-average particle diameter of from 6 nm to 40 nm. The external additives may be used alone or in combination of two or more.

When the inorganic fine particles are subjected to a hydrophobic treatment, the charging performance and environmental stability of the toner can be further improved. Examples of the treatment agent used in the hydrophobic treatment include silicone varnish, various modified silicone varnishes, silicone oil, various modified silicone oils, silane compounds, silane coupling agents, other organosilicon compounds, organotitanium compounds, and the like. The treatment agents may be used alone or in combination of two or more.

The number-average particle diameter of the primary particles of the inorganic fine particles may be calculated using an image of the toner enlarged and captured by a scanning electron microscope (SEM).

In the method for producing toner particles by a suspension polymerization method, generally, a polymerizable monomer obtained by adding, as appropriate, the above-described toner composition and uniformly dissolving or dispersing with a disperser such as a homogenizer, a ball mill, an ultrasonic disperser, or the like is preferably dispersed in an aqueous medium including a dispersant.

At this time, where a high-speed disperser such as a high-speed stirrer or an ultrasonic disperser is used, the particle diameter of the obtained toner particles becomes sharper. The time when the polymerization initiator is added may be the same as when other additives are added to the polymerizable monomer, or may be immediately before the dispersion in the aqueous medium. Further, a polymerization initiator dissolved in a polymerizable monomer or a solvent can be added immediately after granulation and before starting the polymerization reaction.

After the granulation, stirring may be performed using a normal stirrer to such an extent that the particle state is maintained and the floating and settling of the particles are prevented.

Examples of the inorganic fine particles include silica fine particles, titanium oxide fine particles, alumina fine particles, and the like. As the silica fine particles, for example, both a so-called dry silica, which is referred to as dry-method silica or fumed silica and is produced by vapor phase oxidation of a silicon halide, and a so-called wet silica produced from water glass or the like can be used.

However, dry silica having fewer silanol groups on the surface and inside the silica fine particles and having less production residue such as $Na_2O$ and $SO_3^{2-}$ is more preferable.

Further, in the case of fumed silica, in the production process, for example, it is also possible to obtain composite fine particles of silica and another metal oxide by using another metal halide such as aluminum chloride, titanium chloride, and the like together with a silicon halide. The composite fine particles can also be used as the inorganic fine particles.

The amount of the inorganic fine particles is preferably from 0.1 part by mass to 3.0 parts by mass with respect to 100 parts by mass of the toner particles. The amount of the inorganic fine particles may be quantified from a calibration curve prepared from a standard sample using a fluorescent X-ray analyzer.

The toner particle may further include other additives within a range in which no substantial adverse effect is produced.

Examples of the other additives include lubricant powders such as fluororesin powder, zinc stearate powder, and polyvinylidene fluoride powder; abrasives such as cerium oxide powder, silicon carbide powder, strontium titanate powder and the like; anti-caking agents; and the like. The additive can be used after the surface thereof is subjected to a hydrophobic treatment.

The glass transition temperature (Tg) of the toner is preferably from 45.0° C. to 65.0° C., and more preferably from 50.0° C. to 65.0° C.

When the glass transition temperature is in the above range, both storage stability and low-temperature fixability can be achieved at a high level. The glass transition temperature can be controlled by the composition of the binder resin, the type of the crystalline material, the molecular weight of the binder resin, and the like.

The weight-average particle diameter (D4) of the toner is preferably from 3.0 μm to 8.0 μm, and more preferably from 5.0 μm to 7.7 μm.

By setting the weight-average particle diameter (D4) of the toner within the above range, it is possible to sufficiently satisfy the dot reproducibility while improving the handleability of the toner.

Further, the ratio (D4/D1) of the weight-average particle diameter (D4) to the number-average particle diameter (D1) of the magnetic toner is preferably less than 1.25.

Methods for measuring physical property values are described below.

<Method for Measuring Dipole Interaction Term of Hansen Solubility Parameter>

Where the raw materials of the toner are obtained, first, for the surface-treated magnetic body A, the molecular structure of the raw material of the hydrophobic treatment agent is specified, and for the resin B and the resin C, the molecular structure of each raw material is specified. Means for specifying the molecular structure is not particularly limited, and for example, a technique such as a safety data sheet (SDS) can be used.

Based on the specified molecular structure, the dipole interaction term of Hansen solubility parameter is calculated from the calculation software. The calculation software is not particularly limited. For example, HSPiP (available from http://pirika.com/JP/HSP/index.html) can be used.

When raw materials cannot be obtained directly or when an existing toner is used as a sample, the dipole interaction term of Hansen solubility parameter is calculated by identifying the constituent materials of the toner and the molecular structure of the constituent material by using an analytical instrument such as a nuclear magnetic resonance apparatus (NMR) and gas chromatography/mass spectrometry (GC/MS).

<Method for Measuring Weight-Average Particle Diameter (D4) and Number-Average Particle Diameter (D1) of Toner>

The weight-average particle diameter (D4) and the number-average particle diameter (D1) of the toner are calculated as follows.

A precision particle diameter distribution measuring apparatus "Coulter Counter Multisizer 3®" (manufactured by Beckman Coulter, Inc.) based on a pore electric resistance method and equipped with a 100-μm aperture tube is used as a measurement device. The dedicated software "Beckman Coulter Multisizer 3 Version 3.51" (manufactured by Beckman Coulter, Inc.) is used for setting measurement conditions and analyzing the measurement data. The measurement is performed with 25,000 effective measurement channels.

A solution prepared by dissolving special grade sodium chloride in ion exchanged water to a concentration of about 1% by mass, for example, "ISOTON II" (manufactured by Beckman Coulter, Inc.), can be used as the electrolytic aqueous solution to be used for the measurement.

The dedicated software is set up in the following manner before the measurement and analysis.

The total count number in a control mode is set to 50,000 particles on a "Changing Standard Operating Method (SOM)" screen in the dedicated software, the number of measurements is set to 1, and a value obtained using "standard particles 10.0 μm" (manufactured by Beckman Coulter, Inc.) is set as a Kd value. The threshold and the noise level are automatically set by pressing the "Threshold/Measure Noise Level". Further, the current is set to 1,600 μA, the gain is set to 2, the electrolytic solution is set to ISOTON II, and "Flush Aperture Tube" of "After Each Run" is checked.

In the "Convert Pulses to Size Settings" screen of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 revolutions per second. Dirt and air bubbles in the aperture tube are removed by the "Flush Aperture Tube" function of the dedicated software.

(2) Approximately 30 ml of the electrolytic aqueous solution is placed in a glass 100 mL flat-bottom beaker. Then, about 0.3 mL of a diluted solution obtained by about 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersant thereto.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. A total of about 3.3 L of ion exchanged water is placed in the water tank of the ultrasonic disperser, and about 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion process, the water temperature in the water tank is appropriately adjusted to a temperature from 10° C. to 40° C.

(6) The electrolytic aqueous solution of (5) hereinabove in which the toner is dispersed is dropped by using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the device, and the weight-average particle diameter (D4) and the number-average particle diameter (D1) are calculated. The "Average Diameter" on the "Analyze/Volume Statistics (Arithmetic Mean)" screen obtained when the graph/(% by volume) is set in the dedicated software is taken as the weight-average particle diameter (D4), and the "Average Diameter" on the "Analyze/Number Statistics (Arithmetic Mean)" screen obtained when the graph/(% by number) is set in the dedicated software is taken as the number-average particle diameter (D1).

<Method for Measuring Peak Temperature (Melting Point) of Maximum Endothermic Peak>

The peak temperature of the maximum endothermic peak of a sample such as a toner or a resin is measured under the following conditions by using a differential scanning calorimeter (DSC) Q2000 (manufactured by TA Instruments).

Ramp rate: 10° C./min

Measurement start temperature: 20° C.

Measurement end temperature: 180° C.

The melting points of indium and zinc are used for temperature correction of the apparatus detection unit, and the heat of melting of indium is used for correction of the calorific value.

Specifically, 5 mg of a sample is accurately weighed and placed in an aluminum pan, and measured once. An empty pan made of aluminum is used as a reference. The peak temperature of the maximum endothermic peak at that time is determined. The peak temperature of the maximum endothermic peak is taken as the melting point.

<Method for Measuring Glass Transition Temperature (Tg)>

The glass transition temperature of a sample such as a toner, a resin, or the like is determined using a reversing heat flow curve at the time of temperature increase obtained by differential scanning calorimetry of the peak temperature of the maximum endothermic peak, and is a temperature (° C.)

at a point where a straight line equidistant in the vertical axis direction from a straight line obtained by extending the base line before and after a specific heat change and a curve of a stepwise change portion of glass transition in the reversing heat flow curve intersect each other.

<Method for Measuring Weight-Average Molecular Weight (Mw) and Peak Molecular Weight (Mp)>

The peak molecular weight (Mp) of a sample such as a resin and other materials is measured in the following manner by gel permeation chromatography (GPC).

(1) Preparation of Measurement Sample

A sample and tetrahydrofuran (THF) are mixed at a concentration of 5.0 mg/mL, allowed to stand at room temperature for from 5 h to 6 h, and then shaken sufficiently, and the THF and the sample are mixed well until the sample no longer coalesces. The mixture is further allowed to stand at room temperature for 12 h or more. At this time, the time from the start of the mixing of the sample and THF to the end of the standing is set to be 72 h or more, and a tetrahydrofuran (THF) soluble matter of the sample is obtained.

Thereafter, the mixture is filtered through a solvent-resistant membrane filter (pore size: from 0.45 μm to 0.50 Maishori Disk H-25-2 [manufactured by Tosoh Corporation]) to obtain a sample solution.

(2) Sample Measurement

Measurements were conducted under the following conditions by using the sample solution obtained.

Device: high-speed GPC device LC-GPC 150C (manufactured by Waters Corp.)

Column: 7 sets of Shodex GPC KF-801, 802, 803, 804, 805, 806, and 807 (manufactured by Showa Denko K.K.)

Mobile phase: THF

Flow rate: 1.0 mL/min

Column temperature: 40° C.

Sample injection volume: 100 μL

Detector: RI (refractive index) detector

When measuring the molecular weight of a sample, the molecular weight distribution of the sample is calculated from the relationship between the logarithmic value of a calibration curve prepared from several types of monodisperse polystyrene standard samples and the count number.

Standard polystyrene samples used for preparing a calibration curve are manufactured by Pressure Chemical Co. or Toyo Soda Kogyo Co., Ltd. and have a molecular weight of $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$.

<Method for Measuring Load Serving as Yield Point by Nanoindentation Method>

PICODENTOR HM500 manufactured by Fisher Instrument Co., Ltd. is used for measurement of the load corresponding to the yield point by the nanoindentation method. The software WIN-HCU is used. A Vickers indenter (angle: 130°) is used as the indenter.

The measurement includes a step of pushing the indenter for a predetermined time until a predetermined load is obtained (hereinafter, referred to as an "indentation step"). In this measurement, the load application speed is changed by changing the set time and load.

First, a microscope is focused on a video camera screen connected to the microscope displayed on the software. A glass plate (hardness: 3,600 N/mm$^2$) for performing Z-axis alignment described below is used as an object for focusing. At this time, focusing is sequentially performed from the objective lens with a magnification of 5 to those with a magnification of 20 and a magnification of 50. Thereafter, adjustment is performed with the objective lens with a magnification of 50.

Next, an "Approach Parameter Setting" operation is performed using the glass plate that has been focused as described above, and the Z-axis alignment of the indenter is performed. After that, the glass plate is replaced with an acrylic plate, and an "Indenter Cleaning" operation is performed. The "Indenter Cleaning" operation is to clean the indenter tip with a cotton swab moistened with ethanol and to match the indenter position indicated by the software with the indenter position on the hardware, that is, the operation for XY axis alignment of the indenter.

After that, the acrylic plate is replaced with a slide glass with the toner attached thereto, and the microscope is focused on the toner to be measured. The method for attaching the toner to the slide glass is as follows.

First, the toner to be measured is attached to the tip of the cotton swab, the excess toner is sifted off at the edge of the bottle. Then, the toner attached to the swab down is knocked down so as to obtain a toner monolayer on the slide glass while pressing the swab shaft against the edge of the slide glass.

Then, the slide glass to which the toner monolayer has adhered as described above is set on a microscope, the microscope is focused on the toner with the objective lens having a magnification of 50, and the indenter tip is set on the software so as to be at the center of the toner particle. The toner to be selected is limited to particles having a major axis and a minor axis of about D4 (μm)±1.0 μm.

The measurement is performed by implementing the indentation step under the following conditions.

(Indentation Step 1)

Maximum indentation load=1.25 mN

Indentation time=300 sec

Under the above conditions, the indentation speed of 0.42 μN/sec can be set.

In the indentation step, a load-displacement curve is obtained in which the load (mN) is plotted against the ordinate and the displacement (μm) is plotted against the abscissa. Next, using a spreadsheet software (Microsoft Excel), the slope of each plot of the obtained load-displacement curve is determined, thereby obtaining a differential curve obtained by differentiating the load-displacement curve by a small load. From the obtained differential curve, the load having a maximum value is determined, and the load corresponding to the yield point is obtained. The displacement at which the positive load is measured first is defined as the initial value of the displacement.

The above measurement is performed for 30 particles of toner, and the arithmetic average value is used.

In the measurement, the above-described "Indenter Cleaning" operation (including XY axis alignment of the indenter) is always performed for each particle measurement.

<Method for Measuring Powder Dynamic Viscoelasticity of Toner>

Measurement is performed using a dynamic viscoelasticity measuring device DMA8000 (manufactured by Perkin Elmer Corp.).

Measurement jig: material pocket (P/N: N533-0322)

A total of 80 mg of the toner is inserted in the material pocket, and the material pocket is attached to a single cantilever and fixed by tightening the screw with a torque wrench.

Dedicated software "DMA Control Software" (manufactured by Perkin Elmer Corp.) is used for the measurement.

The measurement conditions are as follows. From the curve of the storage elastic modulus E' obtained by this measurement (the temperature (° C.) is plotted against the abscissa, and the storage elastic modulus E' (Pa) is plotted against the ordinate) obtained in the measurement, the temperature at the time when the storage elastic modulus E' at the start of the measurement (25° C.) has decreased by 50% is determined.

Oven: Standard Air Oven
Measurement type: temperature scan
DMA condition: single frequency/distortion (G)
Frequency: 1 Hz
Strain: 0.05 mm
Measurement start temperature: 25° C.
Finish temperature: 180° C.
Ramp rate: 20° C./min
Deformation mode: single cantilever (B)
Cross section: rectangular parallelepiped (R)
Test piece size (length): 17.5 mm
Test piece size (width): 7.5 mm
Test piece size (thickness): 1.5 mm <Method for Measuring Area Ratio A1>

A method for measuring the degree of surface unevenness of the magnetic body in the cross section of the toner observed with a transmission electron microscope (TEM) is as follows.

First, a TEM image of the toner is obtained by the following method.

<Cross-Sectional Observation of Toner>

Cross-sectional observation of the toner with a transmission electron microscope (TEM) is performed as follows. The cross section of the toner is observed by staining with ruthenium. For example, a crystalline resin or the like included in the toner is stained with ruthenium more than an amorphous resin such as a binder resin, so that the contrast becomes clear and observation is facilitated. Since the amount of ruthenium atoms differs depending on the intensity of the staining, the strongly stained portion includes many of these atoms, does not transmit the electron beam, and becomes black on the observed image, and the weakly stained portion easily transmits the electron beam and becomes white on the observed image.

First, a toner is sprayed on a cover glass (Matsunami Glass Co., Ltd., angular cover glass, Square Shape No. 1) so as to form a monolayer, and an Os film (5 nm) and a naphthalene film (20 nm) are coated as protective films by using an Osmium Plasma Coater (filgen, Inc., OPC80T).

Next, a PTFE tube (ϕ1.5 mm×ϕ3 mm×3 mm) is filled with a photocurable resin D800 (JEOL, Ltd.), and the cover glass is placed quietly on the tube in the orientation such that the toner contacts the photocurable resin D800. After curing the resin by irradiation with light in this state, the cover glass and the tube are removed to form a columnar resin in which the toner is embedded on the outermost surface.

The columnar resin is cut at a distance equal to the radius of the toner (4.0 μm when the weight-average particle diameter (D4) is 8.0 μm) from the outermost surface at a cutting speed of 0.6 mm/s by using an ULTRASONIC ULTRAMICROTOME (Leica Microsystems Inc., UC7) to open the cross section of the toner. Next, cutting is performed to obtain a film thickness of 250 nm and prepare a slice sample having the toner cross section. By cutting in such a manner, a cross section of the toner central portion is obtained.

The obtained slice sample is stained in a $RuO_4$ gas at a 500 Pa atmosphere for 15 min using a vacuum electron dyeing apparatus (filgen, Inc., VSC4R1H), and TEM observation is performed using a TEM (JEOL, Ltd., JEM2800).

An image with a TEM probe size of 1 nm and an image size of 1,024 pixels×1,024 pixels is acquired. Also, the Contrast of the Detector Control panel of the image field of view is adjusted to 1425, the Brightness to 3750, the Contrast of the Image Control panel to 0.0, the Brightness to 0.5, and the Gamma to 1.00.

Next, the obtained TEM image is binarized using image processing software "ImageJ" (available from https://imagej.Nih.gov/ij/). Thereafter, a circle equivalent diameter (projected area circle equivalent diameter) is obtained from the binarized image of the cross section, and a cross section for which the value of the circle equivalent diameter is included in a range of ±5% of the number-average particle diameter (D1) (μm) of the toner is selected.

From the TEM image of the corresponding particles, regions other than those necessary for the measurement are masked using "ImageJ", and the area of the unmasked region inside the toner outline and the total area of the magnetic bodies present in the unmasked region are calculated. A method for obtaining the area ratio A1 using this method will be specifically described hereinbelow.

First, the obtained TEM image of the outline of the toner cross section (hereinafter, referred to as image 1) is binarized so that the outline and the inside of the toner particle are white and the other background portions are black (hereinafter, referred to as image 2).

Next, in order to calculate the magnification of the mask, the length per unit pixel number in the image 1 is calculated. Next, from the calculated value, it is calculated how many pixels fit in the range from the contour of the toner particle to 200 nm toward the center of gravity of the toner particle (hereinafter referred to as x1). Similarly, how many pixels fit in the toner particle diameter measured by using the above-described method is calculated (hereinafter referred to as x2). Then, the magnification M of the mask is calculated from:

$$M=(x2-x1)/x2.$$

Next, the image 2 is reduced to the calculated magnification M (the reduced image is referred to as an image 3). In the image 3, the image is processed such that the outline and the inside of the toner particle are black, and the other background portions are transparent.

Next, the image 2 and the image 3 are added. At this time, the image 2 and the image 3 are added using "Image Calculator" which is a function of "ImageJ", and an image 4 is created in which the region from the contour of the toner particle to 200 nm toward the center of gravity of the toner particle is white, and the other parts are black. The area S1 of the white region in the image 4 is measured.

Next, the created image 4 and image 1 are similarly added using "Image Calculator" to create an image 5 in which the region other than the range of 200 nm from the contour of the toner particle toward the center of gravity of the toner particle cross section is masked. The image 5 is binarized, and an area S2 occupied by the surface-treated magnetic body A in the range is measured.

Finally, the area ratio a1 is calculated as S2/S1.

The above operation is performed on 100 toner particles, and the arithmetic average value of the obtained 100 area ratios al is defined as the area ratio A1.

<Method for Calculating B1/(B1+C1)>

Observation is performed by the above-described method for observing the cross section of the toner, 50 toners with a diameter within +2.0 μm from number-average particle diameter are selected and images thereof are captured to obtain cross-sectional images.

As compared with an amorphous resin or a magnetic body, the crystalline material is not stained with Ru, and looks black to gray in the cross-sectional image.

Of the 50 toners from which the cross-sectional image was obtained, the number of toners having a domain of 500 nm or more is taken as B1, the number of toners having no domain of 500 nm or more is taken as C1, and the presence ratio of toner particles having a domain of 500 nm or more is determined from B1/(B1+C1).

<Method for Measuring Carbon Amount Derived from Silane Compound in Surface-Treated Magnetic Body A>

The carbon amount per unit weight of the surface-treated magnetic body A is measured using a carbon/sulfur analyzer (EMIA-320V) manufactured by HORIBA Co. The amount of carbon obtained by this operation is defined as the amount of carbon (unit: mass %) derived from the silane compound. In the measurement, the sample load amount at the time of measurement with EMIA-320V is set to 0.20 g, and a mixture of tungsten and tin is used as an auxiliary agent.

<Method for Measuring Amount of Crystalline Material E>

Where the raw material of the crystalline material E is not available, an isolation operation is performed in the following manner.

First, the toner is dispersed in ethanol, which is a poor solvent for the toner, and the temperature is raised to a temperature exceeding the melting point of the crystalline material E. At this time, pressure may be applied as necessary. At this point in time, the crystalline materials D and E that have exceeded the melting point have been melted. Thereafter, a mixture of the crystalline materials D and E can be collected from the toner by solid-liquid separation. By classifying this mixture for each molecular weight, the crystalline material E can be isolated.

The amount of the crystalline material E is determined from the mass of the crystalline material E separated from the toner by the above method and the mass of the original toner.

EXAMPLES

Hereinafter, the present disclosure will be described in more detail with reference to Examples and Comparative Examples, but the present disclosure is not limited thereto. Unless otherwise specified, all parts and percentages in Examples and Comparative Examples are based on mass.

Production Example of Resin C1

A total of 100 parts of a mixture obtained by mixing raw material monomers other than trimellitic anhydride in the loaded amounts shown in Table 1 below, and 0.52 parts of tin di(2-ethylhexanoate) as a catalyst were placed in a polymerization tank equipped with a nitrogen introduction line, a dehydration line and a stirrer.

Next, after the inside of the polymerization tank was set to a nitrogen atmosphere, a polycondensation reaction was performed over 6 h while heating at 200° C. Further, after the temperature was raised to 210° C., trimellitic anhydride was added, the pressure in the polymerization tank was reduced to 40 kPa, and then the condensation reaction was further performed to obtain an amorphous polyester resin C1. Table 1 shows the Tg and the dipole interaction term c of Hansen solubility parameter of the obtained amorphous polyester resin C1.

Production Examples of Resins C2 and C3

An amorphous polyester resin C2 and an amorphous polyester resin C3 were produced by performing the same operations as in the production of the resin C1 by using the loaded amounts of raw material monomers shown in Table 1. Table 1 shows the dipole interaction term c of Hansen solubility parameter and the glass transition temperature (Tg) of the obtained amorphous polyester resin C2 and amorphous polyester resin C3.

TABLE 1

| | Alcohol component (molar parts) | | | Acid component (molar parts) | | Hansen dipole interaction term c | Tg |
|---|---|---|---|---|---|---|---|
| Resin C | BPA (2 moles PO) | EG | Isosorbide | TPA | TMA | ($MPa^{1/2}$) | (° C.) |
| Resin C1 | 60.0 | 36.0 | 5.0 | 86.0 | 4.0 | 6.00 | 77.0 |
| Resin C2 | 55.0 | 40.0 | 0.0 | 120.0 | 5.0 | 6.60 | 82.0 |
| Resin C3 | 70.0 | 30.0 | 0.0 | 120.0 | 5.0 | 6.30 | 85.0 |

Abbreviations in Table 1 are as follows.

BPA (2 moles PO): bisphenol A propylene oxide 2 moles adduct

EG: ethylene glycol

TPA: terephthalic acid

TMA: trimellitic anhydride

Production Example of Crystalline Material D1

| | |
|---|---|
| Sebacic acid | 100.0 parts |
| 1,9-Nonanediol | 100.0 parts |
| Dibutyltin oxide | 0.1 part |

The above materials were placed in a heated and dried two-necked flask, nitrogen gas was introduced into the vessel to maintain an inert atmosphere, and the temperature was raised while stirring. Thereafter, stirring was performed at 180° C. for 6 h.

Thereafter, the temperature was gradually raised to 230° C. under reduced pressure while stirring was continued, and further maintained for 2 h. When the mixture became viscous, the mixture was air-cooled to stop the reaction, thereby obtaining a crystalline material D1.

Table 2 shows the dipole interaction term d of Hansen solubility parameter and the melting point of the obtained crystalline material D1.

<Crystalline Materials D2 to D4>

Table 2 shows the crystalline materials D2 to D4 used in the present example and comparative examples.

TABLE 2

| Crystalline material D | Name of material | Hansen dipole interaction term d ($MPa^{1/2}$) | Melting point (° C.) |
|---|---|---|---|
| Crystalline material D1 | Crystalline polyester | 2.10 | 66.0 |
| Crystalline material D2 | Dibehenyl sebacate | 1.70 | 74.0 |
| Crystalline material D3 | Behenyl behenate | 1.10 | 74.0 |
| Crystalline material D4 | Behenyl stearate | 1.30 | 68.0 |

<Crystalline Material E>

Table 3 shows the crystalline material E used in the present example and the comparative example.

TABLE 3

| Crystalline material E | Name of material | Hansen dipole interaction term e ($MPa^{1/2}$) | Melting point (° C.) |
|---|---|---|---|
| Crystalline material E1 | Paraffin wax | 0.00 | 75.0 |

Production Example of Magnetic Iron Oxide 1

A caustic soda solution (including 1% by mass of sodium hexametaphosphate in terms of P with respect to Fe) in 1.0 equivalent with respect to iron ion was mixed in a ferrous sulfate aqueous solution to prepare an aqueous solution including ferrous hydroxide. While maintaining the pH of the aqueous solution at 9, the air was blown therein to perform an oxidation reaction at 80° C. to prepare a slurry liquid for generating seed crystals.

Next, an aqueous solution of ferrous sulfate was added to the slurry liquid so that the equivalent amount with respect to the initial alkali amount (the sodium component of caustic soda) was 1.0 equivalent. The slurry liquid was maintained at pH 8 to advance the oxidation reaction while blowing air, and the pH was adjusted to 6 at the end of the oxidation reaction, followed by washing and drying to obtain a magnetic iron oxide 1 in the form of spherical magnetite particles that had the number-average particle diameter of primary particles of 200 nm.

Production Example of Magnetic Iron Oxide 2

A magnetic iron oxide 2 was obtained in the same manner as in the Production Example of Magnetic Iron Oxide 1 except that the liquid temperature during the oxidation reaction in the Production Example of Magnetic Iron Oxide 1 was changed from 80° C. to 65° C. The magnetic iron oxide 2 was in the form of spherical magnetite particles, and the number-average particle diameter of primary particles was 300 nm.

Production Example of Magnetic Iron Oxide 3

A magnetic iron oxide 3 was obtained in the same manner as in the Production Example of Magnetic Iron Oxide 1 except that the liquid temperature during the oxidation reaction in the Production Example of Magnetic Iron Oxide 1 was changed from 80° C. to 74° C. The magnetic iron oxide 3 was in the form of spherical magnetite particles, and the number-average particle diameter of primary particles was 260 nm.

Production Example of Silane Compound 1

A total of 30 parts of n-decyltrimethoxysilane was added dropwise to 70 parts of ion exchanged water while stirring. Thereafter, the aqueous solution was maintained at a pH of 5.5 and a temperature of 55° C., and was dispersed using a disper blade at a peripheral speed of 0.46 m/s for 120 min to perform hydrolysis. Thereafter, the pH of the aqueous solution was adjusted to 7.0, and the solution was cooled to 10° C. to stop the hydrolysis reaction. Thus, an aqueous solution including the hydrolyzate of n-decyltrimethoxysilane (silane compound 1) was obtained.

Production Examples of Silane Compounds from 2 to 4

Silane compounds from 2 to 4 were obtained in the same manner as in the Production Example of Silane Compound 1, except that n-decyltrimethoxysilane was replaced with the raw materials shown in Table 4.

TABLE 4

| Silane compound | Raw material |
|---|---|
| Silane compound 1 | n-Decyltrimethoxysilane |
| Silane compound 2 | n-Octyltrimethoxysilane |
| Silane compound 3 | n-Butyltrimethoxysilane |
| Silane compound 4 | n-Tetradecanetrimethoxysilane |

Production Example of Surface-Treated Magnetic Body A1

A total of 100 parts of the magnetic iron oxide 1 was loaded in Simpson Mix-Muller (model MSG-OL, manufactured by SINTOKOGIO, LTD.) and pulverized for 30 min.

Thereafter, 0.94 parts of the silane compound 1 was added as a hydrophobic treatment agent into the apparatus, and the apparatus was operated for 1 h to obtain a surface-treated magnetic body A1.

The obtained surface-treated magnetic body A1 had a spherical particle shape, and the number-average primary particle diameter was 200 nm.

Table 5 shows the dipole interaction term a of Hansen solubility parameter and physical properties of the obtained surface-treated magnetic body A1.

<Production of Surface-Treated Magnetic Bodies A2, A3, and A4>

In the method for producing the surface-treated magnetic body A1, the type and amount of the silane compound were changed, as appropriate, as shown in Table 5. Thus, surface-treated magnetic bodies A2, A3, and A4 were obtained. The surface-treated magnetic bodies A2, A3, and A4 obtained were all spherical in particle shape, and the number-average particle diameter of primary particles was 300 nm, 200 nm, and 200 nm, respectively.

Table 5 shows the dipole interaction term a of Hansen solubility parameters and physical properties of the obtained surface-treated magnetic bodies A2, A3, and A4.

TABLE 5

| Surface-treated magnetic body A | Magnetic iron oxide | Treatment agent | Treatment method | Addition amount of treatment agent (parts) | Amount of carbon derived from silane compound (% by mass) | Hansen dipole interaction term a ($MPa^{1/2}$) |
|---|---|---|---|---|---|---|
| Surface-treated magnetic body A1 | Magnetic iron oxide 1 | Silane compound 1 | Mix-Muller | 0.94 | 0.4 | 1.80 |
| Surface-treated magnetic body A2 | Magnetic iron oxide 2 | Silane compound 1 | Mix-Muller | 0.70 | 0.4 | 1.80 |
| Surface-treated magnetic body A3 | Magnetic iron oxide 1 | Silane compound 2 | Mix-Muller | 1.50 | 0.4 | 2.04 |
| Surface-treated magnetic body A4 | Magnetic iron oxide 1 | Silane compound 4 | Mix-Muller | 0.72 | 0.4 | 1.34 |

<Production of Surface-Treated Magnetic Body A5>

After 100 parts of the magnetic iron oxide 1 was put into a Henschel mixer (Nippon Coke Industry Co., Ltd.), the silane compound 1 (1.12 parts) was added while spraying in a state where the magnetic iron oxide 1 was dispersed at a rotation speed of 34.5 m/s. Next, after dispersing in the same state for 10 min, the magnetic iron oxide 1 on which the silane compound 1 was adsorbed was taken out, and the magnetic iron oxide 1 was dried while being allowed to stay gently at 160° C. for 2 h, and the condensation reaction of the silane compound 1 was performed. Thereafter, the mixture was passed through a sieve having openings of 100 μm to obtain a surface-treated magnetic body A5.

The obtained surface-treated magnetic body A5 had a spherical particle shape, and the number-average particle diameter of primary particles was 200 nm. Table 6 below shows the dipole interaction term a of Hansen solubility parameter and the physical properties of the obtained surface-treated magnetic body A5.

TABLE 6

| Surface-treated magnetic body A | Magnetic iron oxide | Treatment agent | Treatment method | Addition amount of treatment agent (parts) | Amount of carbon derived from silane compound (% by mass) | Hansen dipole interaction term a ($MPa^{1/2}$) |
|---|---|---|---|---|---|---|
| Surface-treated magnetic body A5 | Magnetic iron oxide 1 | Silane compound 1 | Henschel mixer | 1.12 | 1.1 | 1.80 |

<Production of Surface-Treated Magnetic Body A6>

A total of 100 parts of the magnetic iron oxide 3 and 1.00 part of the silane compound 3 were dispersed in an aqueous medium, sufficiently stirred, and subjected to hydrophobic treatment by a wet method. The produced hydrophobic magnetic iron oxide was washed, filtered and dried by a conventional method. Thereafter, a magnetic body passed through a sieve having openings of 100 was obtained as a surface-treated magnetic body A6. The obtained surface-treated magnetic body A6 had a spherical particle shape, and the number-average particle diameter of primary particles was 260 nm. Table 7 shows the dipole interaction term a of Hansen solubility parameter and physical properties of the obtained surface-treated magnetic body A6.

TABLE 7

| Surface-treated magnetic body A | Magnetic iron oxide | Treatment agent | Treatment method | Addition amount of treatment agent (parts) | Amount of carbon derived from silane compound (% by mass) | Hansen dipole interaction term a ($MPa^{1/2}$) |
|---|---|---|---|---|---|---|
| Surface-treated magnetic body A6 | Magnetic iron oxide 3 | Silane compound 3 | Wet | 1.00 | 0.5 | 2.50 |

<Production of Toner Particles 1>

A total of 450 parts of a 0.1 mol/L-$Na_3PO_4$ aqueous solution was added to 720 parts of ion exchanged water followed by heating to a temperature of 60° C., and then 67.7 parts of a 1.0 mol/L-$CaCl_2$ aqueous solution was added to obtain an aqueous medium including a dispersion stabilizer.

| | |
|---|---|
| Styrene | 75.0 parts |
| n-Butyl acrylate | 25.0 parts |
| Crosslinking agent (1,6-hexanediol diacrylate) | 1.5 parts |
| Resin C1 | 5.0 parts |
| Negative charge control agent T-77 (manufactured by Hodogaya Chemical Co., Ltd.) | 1.0 part |
| Surface treated magnetic body A1 | 65.0 parts |

The above materials were uniformly dispersed and mixed using an attritor (Nippon Coke Industry Co., Ltd.). This monomer composition was heated to a temperature of 60° C., and the following materials were mixed and dissolved therein to obtain a polymerizable monomer composition.

| | |
|---|---|
| Crystalline material D1 | 10.0 parts |
| Crystalline material E1 (HNP-51: manufactured by Nippon Seiro Co., Ltd.) | 3.0 parts |
| Polymerization initiator (t-butyl peroxypivalate (25% toluene solution)) | 10.0 parts |

The polymerizable monomer composition was loaded into the aqueous medium and granulated by stirring at a rotation speed of 10,000 rpm for 15 min with T. K. HOMOMIXER (Tokushu Kika Kogyo Co., Ltd.) in a $N_2$ atmosphere at a temperature of 60° C. Thereafter, the mixture was stirred with a paddle stirring blade, and a polymerization reaction was performed at a reaction temperature of 70° C. for 300 min.

After the completion of the reaction, the temperature was raised to 98° C. and distillation was performed for 3 h to obtain a reaction slurry. Thereafter, as a cooling step, water at 0° C. was poured into the suspension, and the suspension was cooled from 100° C. to 30° C. at a rate of 100° C./min, then heated to 50° C. and allowed to stand for 6 h.

The suspension was then naturally cooled to 25° C. at room temperature. The cooling rate at that time was 1° C./min. Thereafter, hydrochloric acid was added to the suspension for sufficient washing thereby dissolving the dispersion stabilizer, followed by filtration and drying to obtain toner particles 1. Table 8 shows the formulation of the obtained toner particles 1.

TABLE 8

| | Surface-treated magnetic body A | | Resin B | | | |
|---|---|---|---|---|---|---|
| Toner particle | Type | Addition amount (parts) | Addition amount of styrene (parts) | Addition amount of n-butyl acrylate (parts) | Addition amount of acrylonitrile (parts) | Hansen dipole interaction term b ($MPa^{1/2}$) |
| 1 | A1 | 65.0 | 75.0 | 25.0 | 0.0 | 1.2 |
| 2 | A1 | 75.0 | 75.0 | 25.0 | 0.0 | 1.2 |
| 3 | A1 | 90.0 | 75.0 | 25.0 | 0.0 | 1.2 |
| 4 | A1 | 50.0 | 75.0 | 25.0 | 0.0 | 1.2 |
| 5 | A2 | 40.0 | 75.0 | 25.0 | 0.0 | 1.2 |
| 6 | A1 | 65.0 | 75.0 | 25.0 | 0.0 | 1.2 |
| 7 | A1 | 50.0 | 75.0 | 25.0 | 0.0 | 1.2 |
| 8 | A1 | 65.0 | 75.0 | 25.0 | 0.0 | 1.2 |
| 9 | A1 | 65.0 | 75.0 | 25.0 | 0.0 | 1.2 |
| 10 | A3 | 65.0 | 75.0 | 25.0 | 0.0 | 1.2 |
| 11 | A1 | 65.0 | 75.0 | 25.0 | 0.0 | 1.2 |
| 12 | A1 | 65.0 | 75.0 | 25.0 | 0.0 | 1.2 |
| 13 | A1 | 65.0 | 75.0 | 25.0 | 0.0 | 1.2 |
| 14 | A3 | 65.0 | 67.0 | 22.0 | 11.0 | 2.9 |
| 15 | A3 | 65.0 | 65.0 | 22.0 | 13.0 | 3.3 |
| 16 | A4 | 65.0 | 75.0 | 25.0 | 0.0 | 1.2 |
| 17 | A1 | 40.0 | 75.0 | 25.0 | 0.0 | 1.2 |
| 18 | A1 | 90.0 | 80.0 | 20.0 | 0.0 | 1.1 |
| 19 | A5 | 65.0 | 75.0 | 25.0 | 0.0 | 1.2 |
| 20 | A6 | 50.0 | 75.0 | 25.0 | 0.0 | 1.2 |
| 21 | A1 | 50.0 | 75.0 | 25.0 | 0.0 | 1.2 |

| | Resin C | | Crystalline material D | | Crystalline material E | | Cooling |
|---|---|---|---|---|---|---|---|
| Toner particle | Type | Addition amount (parts) | Type | Addition amount (parts) | Type | Addition amount (parts) | rate to 30° C. (° C./min) |
| 1 | C1 | 5.0 | D1 | 10.0 | E1 | 3.0 | 100 |
| 2 | C1 | 5.0 | D1 | 10.0 | E1 | 3.0 | 3 |
| 3 | C1 | 5.0 | D1 | 10.0 | E1 | 3.0 | 3 |
| 4 | C1 | 5.0 | D1 | 10.0 | E1 | 3.0 | 100 |
| 5 | C1 | 5.0 | D1 | 10.0 | E1 | 3.0 | 100 |
| 6 | C1 | 5.0 | D1 | 10.0 | E1 | 5.0 | 3 |
| 7 | C1 | 5.0 | D1 | 10.0 | E1 | 10.0 | 3 |
| 8 | C1 | 5.0 | D2 | 5.0 | E1 | 3.0 | 3 |
| 9 | C1 | 5.0 | D3 | 5.0 | E1 | 15.0 | 3 |
| 10 | C1 | 5.0 | D4 | 10.0 | E1 | 3.0 | 100 |
| 11 | C1 | 5.0 | D1 | 30.0 | E1 | 3.0 | 3 |
| 12 | C2 | 5.0 | D1 | 10.0 | E1 | 5.0 | 3 |
| 13 | C3 | 5.0 | D1 | 10.0 | E1 | 3.0 | 3 |
| 14 | C1 | 5.0 | D1 | 35.0 | E1 | 3.0 | 100 |
| 15 | C1 | 5.0 | D1 | 35.0 | E1 | 3.0 | 100 |
| 16 | C1 | 5.0 | D1 | 10.0 | E1 | 3.0 | 100 |

TABLE 8-continued

| | | | | | | | |
|---|---|---|---|---|---|---|---|
| 17 | C1 | 5.0 | D1 | 35.0 | E1 | 3.0 | 3 |
| 18 | C1 | 5.0 | D1 | 3.0 | E1 | 3.0 | 3 |
| 19 | C1 | 5.0 | D4 | 10.0 | E1 | 15.0 | 50 |
| 20 | C1 | 5.0 | D4 | 10.0 | E1 | 10.0 | 3 |
| 21 | C1 | 5.0 | D1 | 30.0 | E1 | 3.0 | 3 |

<Production of Toner Particles from 2 to 21>

Toner particles from 2 to 21 were obtained by performing the same operations as in the Production of Toner Particles 1, except that the types and amounts of the surface-treated magnetic body A, monomers constituting the resin B, the resin C, the crystalline material D and the crystalline material E, and the cooling rate in the cooling step in the Production of Toner Particles 1 were changed as shown in Table 8. The physical properties of the produced toner particles are as shown in Table 8 above.

Production Example of Toner 1

A total of 0.3 parts of sol-gel silica fine particles having a number-average particle diameter of primary particles of 115 nm was added to 100 parts of toner particles 1, and mixing was performed using a FM mixer (manufactured by Nippon Coke Industries, Ltd.). Thereafter, 0.9 parts of hydrophobic silica fine particles obtained by treating silica fine particles having a number-average particle diameter of primary particles of 12 nm with hexamethyldisilazane and then treated with silicone oil and having a BET specific surface area value of 120 $m^2/g$ after the treatment was further added, followed by likewise mixing with the FM mixer (manufactured by Nippon Coke Industries, Ltd.) to obtain a toner 1.

The results for the obtained toner 1 are shown in Table 9 below.

Production Examples of Toners from 2 to 21

Toners from 2 to 21 were obtained in the same manner as in the Production Example of Toner 1 except that the toner particles shown in Table 9 were used in the Production Example of Toner 1. Table 9 shows the physical properties of toners from 2 to 21.

<Image Forming Apparatus>

LaserJet Pro M12 (manufactured by Hewlett-Packard Co.) of a one-component contact developing system was used after being modified to 200 mm/sec which is faster than the original process speed. Table 10 shows the evaluation results. The evaluation method and evaluation criteria in each evaluation are as follows.

<Evaluation of Storage Stability>

In the storage stability test, after a solid image was outputted in a high-temperature and high-humidity environment (32.5° C., 80% RH), each developing device was stored in a severe environment (45.0° C., 90% RH) for 30 days. After storage, a solid image was outputted in a high-temperature and high-humidity environment (32.5° C., 80% RH), and evaluation was performed according to the following criteria by using the image density difference before and after the storage. The density of the solid image was measured with a Macbeth reflection densitometer (manufactured by Macbeth Co.).

TABLE 9

| Toner | Toner particle | *1 | *2 | Area ratio A1 (%) | B1/ (B1 + C1) | Toner Tg (° C.) | Toner D4 (μm) | b < c | b < a < c | \|b − a\| | \|c − a\| | \|d − a\| | \|e − a\| |
|---|---|---|---|---|---|---|---|---|---|---|---|---|---|
| 1 | 1 | 79 | 0.87 | 53 | 0.00 | 60.1 | 7.2 | Satisfied | Satisfied | 0.60 | 4.20 | 0.30 | 1.80 |
| 2 | 2 | 84 | 0.91 | 79 | 0.00 | 59.8 | 7.5 | Satisfied | Satisfied | 0.60 | 4.20 | 0.30 | 1.80 |
| 3 | 3 | 90 | 1.60 | 85 | 0.00 | 59.7 | 7.5 | Satisfied | Satisfied | 0.60 | 4.20 | 0.30 | 1.80 |
| 4 | 4 | 74 | 0.82 | 38 | 0.00 | 60.0 | 7.3 | Satisfied | Satisfied | 0.60 | 4.20 | 0.30 | 1.80 |
| 5 | 5 | 70 | 0.80 | 33 | 0.00 | 59.8 | 7.3 | Satisfied | Satisfied | 0.60 | 4.20 | 0.30 | 1.80 |
| 6 | 6 | 80 | 0.82 | 40 | 0.20 | 59.7 | 7.7 | Satisfied | Satisfied | 0.60 | 4.20 | 0.30 | 1.80 |
| 7 | 7 | 85 | 0.80 | 38 | 0.50 | 59.9 | 7.6 | Satisfied | Satisfied | 0.60 | 4.20 | 0.30 | 1.80 |
| 8 | 8 | 90 | 0.90 | 50 | 0.00 | 60.8 | 7.5 | Satisfied | Satisfied | 0.60 | 4.20 | 0.10 | 1.80 |
| 9 | 9 | 86 | 0.85 | 50 | 0.60 | 60.9 | 7.5 | Satisfied | Satisfied | 0.60 | 4.20 | 0.70 | 1.80 |
| 10 | 10 | 80 | 0.83 | 40 | 0.00 | 60.0 | 7.3 | Satisfied | Satisfied | 0.84 | 3.96 | 0.74 | 2.04 |
| 11 | 11 | 60 | 0.83 | 55 | 0.00 | 59.6 | 7.2 | Satisfied | Satisfied | 0.60 | 4.20 | 0.30 | 1.80 |
| 12 | 12 | 80 | 0.81 | 45 | 0.20 | 59.7 | 7.7 | Satisfied | Satisfied | 0.60 | 4.80 | 0.30 | 1.80 |
| 13 | 13 | 80 | 0.80 | 40 | 0.00 | 59.8 | 7.7 | Satisfied | Satisfied | 0.60 | 4.50 | 0.30 | 1.80 |
| 14 | 14 | 70 | 0.80 | 30 | 0.00 | 59.6 | 7.2 | Satisfied | Not satisfied | 0.86 | 3.96 | 0.06 | 2.04 |
| 15 | 15 | 71 | 0.80 | 27 | 0.00 | 59.5 | 7.2 | Satisfied | Not satisfied | 1.26 | 3.96 | 0.06 | 2.04 |
| 16 | 16 | 85 | 0.80 | 29 | 0.00 | 59.7 | 7.2 | Satisfied | Satisfied | 0.14 | 4.66 | 0.76 | 1.34 |
| 17 | 17 | 50 | 0.50 | 20 | 0.00 | 60.0 | 8.0 | Satisfied | Satisfied | 0.60 | 4.20 | 0.30 | 1.80 |
| 18 | 18 | 110 | 1.60 | 50 | 0.00 | 70.0 | 7.9 | Satisfied | Satisfied | 0.70 | 4.20 | 0.30 | 1.80 |
| 19 | 19 | 75 | 0.42 | 30 | 0.60 | 60.1 | 8.0 | Satisfied | Satisfied | 0.60 | 4.20 | 0.50 | 1.80 |
| 20 | 20 | 71 | 0.60 | 32 | 0.50 | 60.0 | 8.0 | Satisfied | Satisfied | 1.30 | 3.50 | 1.20 | 2.50 |
| 21 | 21 | 55 | 0.80 | 34 | 1.00 | 58.9 | 8.3 | Satisfied | Satisfied | 0.60 | 4.20 | 0.30 | 1.80 |

*1: Temperature (° C.) at the time when storage elastic modulus E' at the start of measurement has decreased by 50%

*2: Load at yield point (mN)

A: image density difference is less than 0.05

B: image density difference is 0.05 or more and less than 0.10

C: image density difference is 0.10 or more and less than 0.20

D: image density difference is 0.20 or more

<Evaluation of Trailing Edge Offset (Low-Temperature Fixability)>

The low-temperature fixability was evaluated in a normal-temperature and high-humidity environment (25.0° C., 80% RH).

As an evaluation image, a vertical band solid image was drawn on a Canon A4 size Oce Red Label paper (basis weight 80 g/m$^2$) with an adjustment such that the left and right margins were 5 mm and the top and bottom margins were 5 mm. As a result of setting an image not to be placed on the toner in the thermistor portion of the fixing device in this way, the temperature control is not performed, so that the evaluation conditions become more severe.

Using this image, the presence or absence of a trailing edge offset at each fixing temperature was visually checked while changing the set temperature control every 5° C. in the fixing temperature range from 170° C. to 200° C.

The evaluation was made based on the following criteria.

A: no trailing edge offset at 170° C.

B: no trailing edge offset at 175° C.

C: no trailing edge offset 180° C.

D: a trailing edge offset occurs at 185° C. or higher

<Fogging on Post-White Paper Under High-Temperature and High-Humidity Environment>

Evaluation of fogging on post-white paper was performed in a high-temperature and high-humidity environment (32.5° C., 80% RH). The measurement of fogging was performed using REFLECTMETER MODEL TC-6DS manufactured by Tokyo Denshoku Co., Ltd. A green filter was used as the filter.

"Fogging on post-white paper" was calculated by outputting a white image on paper having Post-it® attached at the center after printing 1,500 prints and 3,000 prints using the above-described image forming apparatus, and subtracting the reflectance of a white background portion other than the Post-it® from the reflectance on the paper in the portion from which the Post-it® was removed.

A: less than 5.0%

B: 5.0% or more and less than 10.0%

C: 10.0% or more and less than 15.0%

D: 15.0% or more

TABLE 10

| | Toner | Storage stability | T railing edge offset | Fogging on post-white paper 1500 prints | Fogging on post-white paper 3000 prints |
|---|---|---|---|---|---|
| Example 1 | 1 | A(0.03) | A(170) | A(2.4) | A(4.3) |
| Example 2 | 2 | A(0.03) | A(170) | A(2.5) | A(4.4) |
| Example 3 | 3 | A(0.01) | B(175) | A(2.5) | A(4.2) |
| Example 4 | 4 | B(0.05) | A(170) | B(5.1) | B(8.9) |
| Example 5 | 5 | B(0.07) | A(170) | B(6.5) | B(9.5) |
| Example 6 | 6 | B(0.08) | B(175) | B(5.3) | B(9.0) |
| Example 7 | 7 | B(0.07) | B(175) | B(6.7) | B(9.8) |
| Example 8 | 8 | A(0.04) | C(180) | A(3.7) | A(4.8) |
| Example 9 | 9 | C(0.18) | C(180) | A(3.9) | A(4.9) |
| Example 10 | 10 | C(0.19) | B(175) | A(4.2) | A(4.6) |
| Example 11 | 11 | C(0.15) | A(170) | C(12.8) | C(14.7) |
| Example 12 | 12 | B(0.08) | B(175) | C(11.8) | C(14.1) |
| Example 13 | 13 | B(0.09) | B(175) | C(12.7) | C(14.9) |
| Example 14 | 14 | C(0.16) | A(170) | C(12.1) | C(14.0) |
| Example 15 | 15 | C(0.16) | A(170) | C(12.8) | C(14.8) |

TABLE 10-continued

| | Toner | Storage stability | T railing edge offset | Fogging on post-white paper 1500 prints | Fogging on post-white paper 3000 prints |
|---|---|---|---|---|---|
| Example 16 | 16 | A(0.03) | B(175) | C(12.7) | C(14.6) |
| Comparative Example 1 | 17 | D(0.35) | A(170) | D(20.1) | D(25.4) |
| Comparative Example 2 | 18 | B(0.07) | D(200) | B(6.9) | B(9.9) |
| Comparative Example 3 | 19 | D(0.28) | B(175) | D(25.1) | D(38.2) |
| Comparative Example 4 | 20 | D(0.31) | B(175) | D(21.1) | D(28.2) |
| Comparative Example 5 | 21 | D(0.35) | B(175) | D(25.4) | D(30.2) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-090406, filed May 13, 2019 which is hereby incorporated by reference herein in its entirety.

What is claimed is:

1. A toner, comprising:

a toner particle including a binder resin and a resin C;

resin C being an amorphous polyester resin including an isosorbide unit represented by formula (1)

(1)

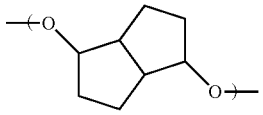

wherein in a powder dynamic viscoelasticity measurement method with a measurement start temperature of 25° C., and a ramp rate of 20° C./min, a temperature is 60 to 90° C. at a time when the storage elastic modulus E' (Pa) at a start of a measurement has decreased by 50% on a curve of a storage elastic modulus E' where temperature (° C.) is plotted against an abscissa and the storage elastic modulus E is plotted against an ordinate, and a load at a yield point is 0.80 mN or more of a displacement-load curve determined by a nanoindentation method where load (mN) is plotted against an ordinate and a displacement amount (μm) is plotted against an abscissa.

2. The toner according to claim 1, wherein the toner particle includes magnetic body A surface-treated with a hydrophobic treatment agent including an organic compound having a hydrophobic group.

3. The toner according to claim 2, wherein the organic compound comprises a silane compound having a hydrocarbon group having 8 to 16 carbon atoms, an amount of carbon derived from the silane compound in the surface-treated magnetic body A is less than 0.5% by mass, and a (MPa$^{1/2}$) is 1.40 to 2.10 where a is a dipole interaction term of Hansen solubility parameter of the surface-treated magnetic body A.

4. The toner according to claim 2, wherein in a cross section of the toner observed with a transmission electron microscope, A1 is 35 to 80% where A1 is an area ratio occupied by the surface-treated magnetic body A in a range from a contour of the cross section of the toner particle to 200 nm or less in a direction of a center of gravity of the toner particle in the cross section.

5. The toner according to claim 1, wherein the toner particle further includes magnetic body A surface-treated with a hydrophobic treatment agent including an organic compound having a hydrophobic group, and the binder resin includes a resin B such that b<c where b ($MPa^{1/2}$) is a dipole interaction term of Hansen solubility parameter of resin B, and c ($MPa^{1/2}$) is a dipole interaction term of Hansen solubility parameter of resin C.

6. The toner according to claim 5, wherein b<a<c where a ($MPa^{1/2}$) is a dipole interaction term of Hansen solubility parameter of the surface-treated magnetic body A.

7. The toner according to claim 5, wherein $|b-a| \leq 1.10$ and $|c-a| \leq 4.60$ where a ($MPa^{1/2}$) is a dipole interaction term of Hansen solubility parameter of the surface-treated magnetic body A.

8. The toner according to claim 1, wherein the toner particle includes a crystalline material D and magnetic body A surface-treated with a hydrophobic treatment agent including an organic compound having a hydrophobic group, and $|d-a| \leq 0.75$ where d ($MPa^{1/2}$) is a dipole interaction term of Hansen solubility parameter of crystalline material D, and a ($MPa^{1/2}$) is a dipole interaction term of Hansen solubility parameter of the surface-treated magnetic body A.

9. The toner according to claim 8, wherein the toner particle includes a crystalline material D, and in a cross section of the toner observed with a transmission electron microscope, $B1/(B1+C1) \leq 0.20$ where B1 is a number of toners having a domain of crystalline material D having a major axis of 500 nm or more and C1 is a number of toners having no domain of crystalline material D having a major axis of 500 nm or more.

10. The toner according to claim 1, wherein the toner particle includes a crystalline material E and a magnetic body A surface-treated with a hydrophobic treatment agent including an organic compound having a hydrophobic group, an amount of crystalline material E is 5.0 parts by mass or less with respect to 100.0 parts by mass of the binder resin, and $|e-a| \geq 1.50$ where e ($MPa^{1/2}$) is a dipole interaction term of Hansen solubility parameter of the crystalline material E, and a ($MPa^{1/2}$) is a dipole interaction term of Hansen solubility parameter of the surface-treated magnetic body A.

11. A method for producing a toner comprising a toner particle including a binder resin and a resin C, the method comprising the steps of:

dispersing a polymerizable monomer composition in an aqueous medium, and forming particles of the polymerizable monomer composition in the aqueous medium, the polymerizable monomer composition including a polymerizable monomer capable of forming the binder resin, and resin C; and polymerizing the polymerizable monomer included in the particles of the polymerizable monomer composition, wherein resin C is an amorphous polyester resin including an isosorbide unit represented by formula (1)

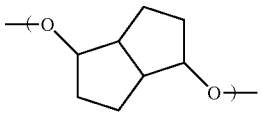

(1)

wherein in a powder dynamic viscoelasticity measurement method with a measurement start temperature of 25° C., and a ramp rate of 20° C./min, a temperature is 60 to 90° C. at a time when the storage elastic modulus E' (Pa) at a start of a measurement has decreased by 50% on a curve of a storage elastic modulus E' where temperature (° C.) is plotted against an abscissa and the storage elastic modulus E is plotted against an ordinate, and a load at a yield point is 0.80 mN or more of a displacement-load curve determined by a nanoindentation method where load (mN) is plotted against an ordinate and a displacement amount (μm) is plotted against an abscissa.

12. The method for producing a toner according to claim 11, wherein the polymerizable monomer composition includes magnetic body A subjected to surface treatment with a hydrophobic treatment agent including an organic compound having a hydrophobic group.

13. The method for producing a toner according to claim 12, wherein the organic compound includes a silane compound having a hydrocarbon group having 8 to 16 carbon atoms, an amount of carbon derived from the silane compound in the surface-treated magnetic body A is less than 0.5% by mass, and a is from 1.40 to 2.10 where a is a dipole interaction term of Hansen solubility parameter of the surface-treated magnetic body A.

14. The method for producing a toner according to claim 11, wherein the polymerizable monomer comprises a polymerizable monomer b capable of forming a resin B, the polymerizable monomer composition further includes a magnetic body A subjected to surface treatment with a hydrophobic treatment agent including an organic compound having a hydrophobic group, and b<a<c where a ($MPa^{1/2}$) is a dipole interaction term of Hansen solubility parameter of the surface-treated magnetic body A, b ($MPa^{1/2}$) is a dipole interaction term of Hansen solubility parameter of the resin B, and c ($MPa^{1/2}$) is a dipole interaction term of Hansen solubility parameter of the resin C.

15. The method for producing a toner according to claim 14, wherein $|b-a| \leq 1.10$ and $|c-a| \leq 4.60$.

16. The method for producing a toner according to claim 11, wherein the polymerizable monomer composition includes a crystalline material D and a magnetic body A subjected to surface treatment with a hydrophobic treatment agent including an organic compound having a hydrophobic group, and $|d-a| \leq 0.75$ where d ($MPa^{1/2}$) is a dipole interaction term of Hansen solubility parameter of the crystalline material D, and a ($MPa^{1/2}$) is a dipole interaction term of Hansen solubility parameter of the surface-treated magnetic body A.

17. The method for producing a toner according to claim 11, wherein the polymerizable monomer composition includes a crystalline material E and a magnetic body A subjected to surface treatment with a hydrophobic treatment agent including an organic compound having a hydrophobic group, an amount of the crystalline material E is 5.0 parts by mass or less with respect to 100.0 parts by mass of the polymerizable monomer capable of forming the binder resin, and $|e-a| \geq 1.50$ where e ($MPa^{1/2}$) is a dipole interaction term of Hansen solubility parameter of the crystalline material E, and a ($MPa^{1/2}$) is a dipole interaction term of Hansen solubility parameter of the surface-treated magnetic body A.

* * * * *